US007672609B2

(12) United States Patent
Koyama et al.

(10) Patent No.: US 7,672,609 B2
(45) Date of Patent: Mar. 2, 2010

(54) TONER CONTAINER AND TONER SUPPLY DEVICE UNIT USING THE SAME

(75) Inventors: Kazuya Koyama, Ikoma (JP); Masanobu Deguchi, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 308 days.

(21) Appl. No.: 11/642,021

(22) Filed: Dec. 20, 2006

(65) Prior Publication Data

US 2007/0172252 A1 Jul. 26, 2007

(30) Foreign Application Priority Data

Jan. 24, 2006 (JP) ..... 2006-015439

(51) Int. Cl.
*G03G 15/08* (2006.01)

(52) U.S. Cl. ..... 399/106; 399/120; 399/258; 399/260; 399/262

(58) Field of Classification Search ..... 399/106, 399/120, 258, 260, 262
See application file for complete search history.

(56) References Cited

U.S. PATENT DOCUMENTS 4,827,307 A * 5/1989 Zoltner ..... 399/106
5,455,662 A 10/1995 Ichikawa et al.
5,528,349 A * 6/1996 Satake ..... 399/262
2005/0123323 A1 * 6/2005 Koyama et al. ..... 399/258

FOREIGN PATENT DOCUMENTS

| | | |
|---|---|---|
| JP | 06-332311 | 12/1994 |
| JP | 6-337586 A | 12/1994 |
| JP | 06-348127 | 12/1994 |
| JP | 6-348127 A | 12/1994 |
| JP | 07-020705 | 1/1995 |
| JP | 7-20705 A | 1/1995 |
| JP | 08-339115 | 12/1996 |
| JP | 8-339115 A | 12/1996 |
| JP | 10-142936 | 5/1998 |
| JP | 2002-351202 A | 12/2002 |
| JP | 2003-162143 | 6/2003 |

* cited by examiner

*Primary Examiner*—David M Gray
*Assistant Examiner*—Geoffrey T Evans
(74) *Attorney, Agent, or Firm*—Nixon & Vanderhye, PC

(57) ABSTRACT

A toner bottle that is composed of a main body filled with toner and a bottle-side toner discharges port for discharging toner from the main body is adapted to discharge the toner in the main body out of the container whilst the toner bottle is being rotated in the toner bottle's peripheral direction. The toner bottle has a sealing element that seals the bottle-side toner discharge port. This sealing element is formed of a flexible member, and is peeled off the main body of the toner bottle as the toner bottle is rotated so as to open the bottle-side toner discharge port.

19 Claims, 25 Drawing Sheets

TONER CONTAINER AND TONER SUPPLY DEVICE UNIT USING THE SAME

This Nonprovisional application claims priority under 35 U.S.C. §119 (a) on Patent Application No. 2006-15439 filed in Japan on 24 Jan. 2006, the entire contents of which are hereby incorporated by reference.

BACKGROUND OF THE TECHNOLOGY

1. Field of the Technology

The present technology relates to a toner container and a toner supply device using this, in particular relating to a container and a toner supply device using this for use in an image forming apparatus for performing image forming with toner.

2. Description of the Prior Art

Conventionally, in image forming apparatuses using toner, such as copiers, facsimile machines, etc., a toner supply device using a toner cartridge etc., is used to supply toner to the developing unit to thereby achieve continuous operation of image output.

Examples of generally known methods for supplying toner to the developing unit include: a configuration in which toner stored in a toner cartridge is directly supplied to the developing unit (Patent document 1: see Japanese Patent Application Laid-open 2003-162143); and a configuration in which toner in a toner cartridge is supplied by a screw from a predetermined position to the developing unit (Patent document 2: see Japanese Patent Application Laid-open Hei 10-142936).

Further, there is a technology by which toner is conveyed to a predetermined position by rotating the toner cartridge itself instead of using a screw (see Patent document 3: Japanese Patent Application Laid-open Hei 7-20705, Patent document 4: Japanese Patent Application Laid-open Hei 8-339115, and Patent document 5: Japanese Patent Application Laid-open Hei 6-348127).

In accordance with this system, since toner is conveyed by rotating the toner cartridge itself, it is not necessary to provide a screw for toner conveyance inside the toner cartridge, hence it is no longer necessary to consider the load on the screw when toner is conveyed. Accordingly, there is the advantage that the ratio of toner stored in the toner cartridge can be increased.

However, in the above-mentioned prior art, when the toner cartridge is mounted to the toner supply device, there is a fear that toner spills out and falls from the toner discharge port formed in the toner cartridge, causing the harmful problem of dirtying the operator and the machine with the spilt toner, hence producing adverse influence on the operativity and maintenance performance.

SUMMARY OF THE TECHNOLOGY

The present technology has been devised in view of the above conventional problems, it is therefore an object of the present technology to provide a toner container which is improved in operativity and maintenance performance by making it easy to handle without causing any spill of toner therefrom when it is full of toner and by facilitating replacement from one to another when toner is supplied, as well as to provide a toner supply device using the above mentioned toner container.

The toner container and the toner supply device using the same container for solving the above problem are configured as follows.

A toner container includes: a toner container body having a toner storing portion filled with toner and a toner discharge port for discharging toner held in the toner storing portion, wherein the toner held in the toner storing portion is discharged out of the container, by rotating the toner container body in the peripheral direction of the toner container body; and a sealing element for sealing the toner discharge port, and is characterized in that the sealing element is formed of a flexible member and is peeled off the toner container body to open the toner discharge port as the toner container body rotates.

In addition to the configuration described in the above first aspect, the toner container body has a cylindrical shape, the toner discharge port is formed at one end portion with respect to the axial direction of the toner container body, and the sealing element is formed in an arc shape and applied over and along the one end portion.

In addition to the configuration described in the above first or second aspect, by inclusion of a toner container holder that covers the one end portion of the toner container body including the toner discharge port and supports the toner container body in a rotatable manner, and in that the sealing element is fixed at one end thereof to the toner container holder.

In addition to the configuration described in the above third aspect, the sealing element is folded inside, and fixed at one end thereof to, the toner container holder, and the folded portion of the sealing element is located on the downstream side of the sealing element's end that is fixed to the toner container holder, with respect to the toner container body's direction of rotation.

In addition to the configuration described in the above third or fourth aspect, the sealing element is fixed to the toner container holder in such a manner that the part extending from the sealing element's fixed end makes an acute angle with the fixed portion of the toner container holder.

In addition to the configuration of anyone of the above third to fifth aspects, the sealing element is adhered to the toner container holder by thermal fusing.

In addition to the configuration of anyone of the above first to sixth aspects, the sealing element is formed of a material having air-permeability.

In addition to the configuration of anyone of the above first to seventh aspects, the sealing element is formed of a material having good slidability.

In addition to the configuration of anyone of the above first to eighth aspects, the sealing element is formed in a shape covering an angular range of 180 degrees with respect to the peripheral direction of the toner container body.

In addition to the configuration of anyone of the above third to sixth aspects, the adhesive strength with which the sealing element is fixed to the toner container holder is specified to be greater than the adhesive strength with which the sealing element seals the toner discharge port of the toner container body.

In addition to the configuration of anyone of the above third to sixth and tenth aspects, the sealing element after separated from the toner container body remains inside the toner container holder with one end thereof fixed to the toner container holder.

A toner supply device includes, a toner container filled with toner; and a toner feed device having the toner container mounted thereon for feeding the toner discharged from the toner container to a developing unit, and wherein the toner container uses a toner container described in any one of the above first to eleventh aspects.

A first embodiment of a toner container includes a toner container body having a toner storing portion filled with toner and a toner discharge port for discharging toner held in the toner storing portion, wherein the toner held in the toner storing portion is discharged out of the container, by rotating the toner container body in the peripheral direction of the toner container body, and a sealing element for sealing the toner discharge port, is constructed such that the sealing element is formed of a flexible member and is peeled off the toner container body to open the toner discharge port as the toner container body rotates. With this configuration, it is possible to handle the toner container filled with toner without spilling the toner therefrom when the toner container is handled alone. When toner needs to be supplied to the developing unit etc., it is possible to replace the toner container with a new one without causing any spill of toner and simply peel off the sealing element to open the toner discharge port by rotating the toner container which has been set in the machine. As a result it is possible to markedly improve the operativity and maintenance performance without making the operator and the machine dirty with spilt toner at all.

Further, in addition to the above common effect that is obtained from the first to twelfth aspects, each aspect has the following effect.

Detailedly, according to the second aspect, since the toner container body has a cylindrical shape, the toner discharge port is formed at one end portion with respect to the axial direction of the toner container body, and the sealing element is formed in an arc shape and applied over and along the one end portion, this configuration, in addition to the effect achieved by the first aspect of the invention, can simplify the handling of the toner container and sealing element and make their configurations simple.

According to the third aspect, since the toner container includes a toner container holder that covers the one end portion of the toner container body including the toner discharge port and supports the toner container body in a rotatable manner, and is constructed such that the sealing element is fixed at one end thereof to the toner container holder, this configuration, in addition to the effect achieved by the first or second aspect, makes it possible to separate the sealing element from the toner container body with a simple structure.

According to the fourth aspect, since the sealing element is folded inside, and fixed at one end thereof to, the toner container holder, and the folded portion of the sealing element is located on the downstream side of the sealing element's end that is fixed to the toner container holder, with respect to the toner container body's direction of rotation, this configuration, in addition to the effect achieved by the third aspect of the invention, makes it possible to assure a large angle for peeling the adhesive part of the sealing element when the sealing element is peeled off by rotation of the toner container body. As a result it is possible to release the opening properly without causing breakage of the sealing element, its peeling from the fixed portion and other failures.

According to the fifth aspect, since the sealing element is fixed to the toner container holder in such a manner that the part extending from the sealing element's fixed end makes an acute angle with the fixed portion of the toner container holder, this configuration, in addition to the effect achieved by the third or fourth aspect, makes it possible to release the opening properly without causing peeling of the sealing element from the fixed portion and other failures when the sealing element is peeled off by rotation of the toner container body.

According to the sixth aspect, since the sealing element is adhered to the toner container holder by thermal fusing, this configuration, in addition to the effect achieved by any one of the third to fifth aspects, makes it possible to achieve reliable sealing with efficient workability and also avoid the necessity of overloaded drive torque and occurrence of the drive being locked and other accidents which are prone to occur when adhesives such as double-side tape etc., are used, or when, for example, toner builds up over the peeled surface on which sticky adhesives have been left over.

According to the seventh aspect, since the sealing element is formed of a material having air-permeability, this configuration, in addition to the effect achieved by any one of the first to sixth aspects, makes it possible to store toner in a stable condition without causing any deformation of the toner container and any toner leakage even when there occurs a pressure difference between the interior and exterior of the toner container due to change in air pressure or the like.

According to the eighth aspect, since the sealing element is formed of a material having good slidability, this configuration, in addition to the effect achieved by any one of the first to seventh aspects, makes it possible to prevent the operations of the toner container body and peripheral parts from being hindered even if the sealing element is separated from the toner container body.

According to the ninth aspect, since the sealing element is formed in a shape covering an angular range of 180 degrees with respect to the peripheral direction of the toner container body, this configuration, in addition to the effect achieved by any one of the first to eighth aspects, makes it possible to prevent the sealing element, even if it is separated from the toner container body, from blocking the toner discharge port when the port is located at the predetermined position, hence discharge toner properly.

According to the tenth aspect, since the adhesive strength with which the sealing element is fixed to the toner container holder is specified to be greater than the adhesive strength with which the sealing element seals the toner discharge port of the toner container body, this configuration, in addition to the effect achieved by any one of the third to sixth aspects, makes it possible to open the toner discharge port by reliably peeling the sealing element off the toner container body.

According to the eleventh aspect, since the sealing element after separated from the toner container body remains inside the toner container holder with one end thereof fixed to the toner container holder, this configuration, in addition to the effect achieved by any one of the third to sixth and tenth aspects, facilitates simple breaking of the seal without the necessity of waste disposal of the sealing element that has been removed from the toner container body.

According to the twelfth aspect, since in a toner supply device including: a toner container filled with toner; and a toner feed device having the toner container mounted thereon for feeding the toner discharged from the toner container to a developing unit, the toner container uses a toner container described in any one of the above first to eleventh aspects, this configuration facilitates mounting of the toner container into the machine without causing any spill of toner and makes it possible to easily open the toner discharge port by peeling the sealing element by rotation of the toner container which has been fitted in the machine. As a result it is possible to provide a toner supply device which is markedly improved in the operativity and maintenance performance without making the operator and the machine dirty with spilt toner.

DESCRIPTION OF THE PREFERRED EMBODIMENTS

The best mode for carrying out the present technology will be described with reference to the drawings.

Figure 1:
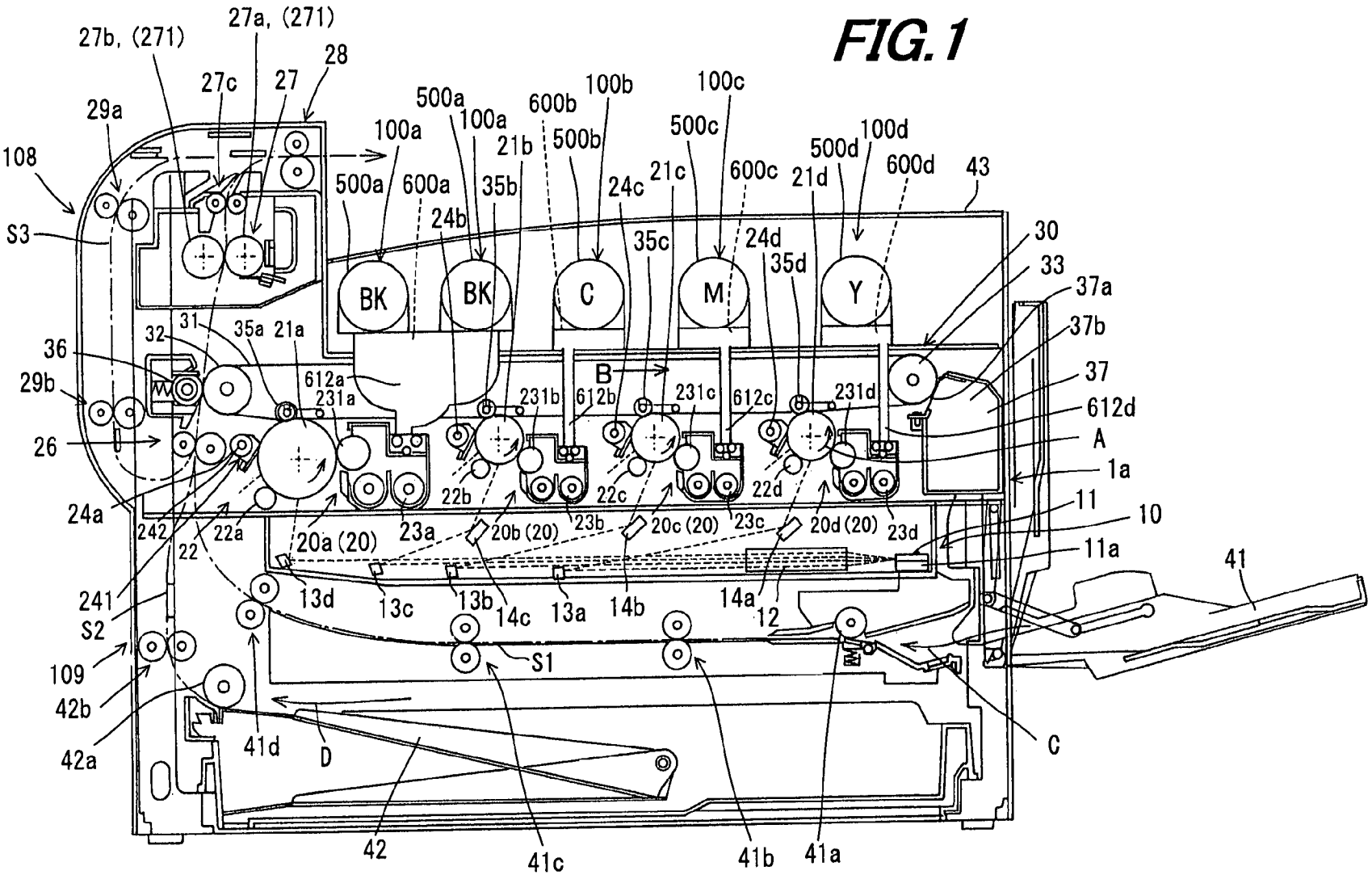
FIG. 1 is an illustrative view showing an overall configuration of an image forming apparatus using a toner container.

FIG. 1 is an example of the mode for carrying out the present technology, and is an illustrative view showing an overall configuration of an image forming apparatus adopting a toner container.

Figure 3:
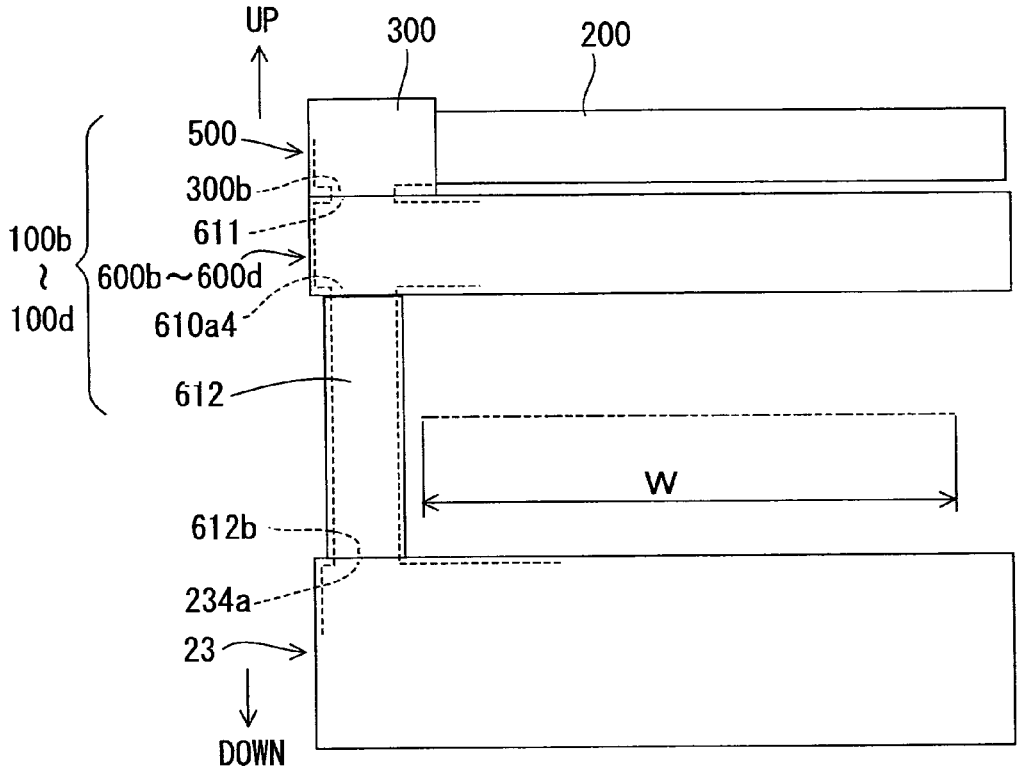
FIG. 3 is an overall front view showing the developing unit and toner supply device.

As shown in FIG. 1, the present embodiment is applied to an image forming apparatus 1 in which developer images formed on photoreceptor drums 21 (21*a*, 21*b*, 21*c* and 21*d*) with developers (toners) which are supplied from developing rollers 231 (231*a*, 231*b*, 231*c* and 231*d*) in accordance with image data are transferred to a recording sheet by a transfer process, and includes toner supply devices 100 (100*a*, 100*b*, 100*c* and 100*d*) each having a toner bottle (toner container) 200 (200*a*, 200*b*, 200*c* or 200*d*: FIG. 3) for supplying toner to developing units 23 (23*a*, 23*b*, 23*c* and 23*d*) so as to perform image output by automatic toner supply to the developing units 23 (23*a*, 23*b*, 23*c* and 23*d*).

As shown in FIG. 1, image forming apparatus includes: a plurality of process printing units (image forming means) 20 (20*a*, 20*b*, 20*c* and 20*d*) each having a photoreceptor drum 21 (21*a*, 21*b*, 21*c* or 21*d*) on which a developer image (which will be referred to as "toner image" hereinbelow) is formed with a developer (which will be referred to as "toner" hereinbelow) corresponding to the color of color-separated image information and a developing unit 23 (23*a*, 23*b*, 23*c* and 23*d*) for supplying the developer to the photoreceptor drum 21 surface; an exposure unit (light scanning device) 10 for creating electrostatic latent images on photoreceptor drums 21 of individual colors by illumination of laser beams in accordance with image information; a transfer belt unit 30 having an endless transfer belt 31 for conveying toner images; and a fixing unit 27 for thermally fixing the toner images transferred to recording paper, by means of a heat roller 27*a* and a pressing roller 27*b*.

To begin with, the overall configuration of image forming apparatus 1 will be described.

As shown in FIG. 1, image forming apparatus 1 according to the present embodiment is a so-called digital color printer which is adapted to output a color image by separating image information into colors and forming images of individual colors, is mainly composed of an image forming portion 108 and a paper feed portion 109, and forms multi-color images or monochrome images on recording paper in accordance with a print job sent from an information processor (not illustrated) such as a personal computer etc., externally connected.

Image forming portion 108 forms multi-color images based on electrophotography with yellow (Y), magenta (M), cyan (C) and black (BK) colors. This image forming portion is mainly composed of exposure unit 10, process printing units 20, fixing unit 27, a transfer belt unit 30 having transfer belt 31 as a transfer means, transfer roller 36 and a transfer belt cleaning unit 37.

In the overall arrangement of image forming portion 108, fixing unit 27 is disposed on the top at one end side of a housing 1*a* of image forming apparatus 1, transfer belt unit 30 is extended under the fixing unit 27 from one end side to the other end side of housing 1*a*, process printing units 20 are disposed under the transfer belt unit 30, and exposure unit 10 is disposed under the process printing units 20.

Further, transfer belt cleaning unit 37 is arranged on the other end side of transfer belt unit 30. Also, a paper output tray 43 is arranged contiguous to fixing unit 27, over image forming portion 108. Paper feed portion 109 is arranged under the image forming portion 108.

In the present embodiment, as process printing units 20, four process printing units 20*a*, 20*b*, 20*c* and 20*d*, corresponding to individual colors, i.e., black (BK), yellow (Y), magenta (M) and cyan (C), are arranged sequentially along transfer belt 31.

These process printing units 20 (20*a*, 20*b*, 20*c* and 20*d*) are arranged in parallel to each other, in the approximately horizontal direction (in the left-to-right direction in the drawing) in housing 1*a*, and include respective photoreceptor drums 21 (21*a*, 21*b*, 21*c* and 21*d*) as the image support for each individual associated color, respective chargers (charging means) 22 (22*a*, 22*b*, 22*c* and 22*d*) for charging the photoreceptor drums 21, respective developing units (developing means) 23 (23*a*, 23*b*, 23*c* and 23*d*) and respective cleaner units 24 (24*a*, 24*b*, 24*c* and 24*d*) and other components.

Here, the symbols a, b, c, and d added to the constituents for individual colors show correspondence to black (BK), yellow (Y), magenta (M) and cyan (C), respectively. In the description hereinbelow, however, the constituents provided for each color are generally referred to as photoreceptor drum 21, charger 22, developing unit 23, and cleaner unit 24, except in the case where the constituents corresponding to a specific color need to be specified.

Photoreceptor drum 21 is arranged so that part of its outer peripheral surface comes into contact with the surface of transfer belt 31 while charger 22 as an electric field generator, developing unit 23 and cleaner unit 24 are arranged along, and close to, the outer peripheral surface of the drum.

As charger 22, a corona-wire charger is used and arranged, at a position on the approximately opposite side across photoreceptor drum 21, from transfer belt unit 30 and close to the outer peripheral surface of photoreceptor drum 21. Though in the present embodiment a corona-wire charger is used as charger 22, any type of charger can be used without limitation, in place of the corona-wire charger, such as a fur brush type charger, magnetic brush type charger, roller-type charger, saw-toothed type charger, ion-generation charging device etc., as long as it can provide the desired charge performance to the photoreceptor drum.

Developing units 23*a*, 23*b*, 23*c* and 23*d* hold associated toners of black (BK), yellow (Y), magenta (M) and cyan (C) colors, each developing unit 23 being arranged on the downstream side of charger 22 with respect to the rotational direction of the photoreceptor drum (in the direction of arrow A in the drawing).

In developing units 23*a*, 23*b*, 23*c* and 23*d*, in order to deal with high-speed and large-volume printing, toner supply devices 100*a*, 100*b*, 100*c* and 100*d* equipped with five toner supply assemblies 500*a*, 500*a*, 500*b*, 500*c* and 500*d* for supplying developers to respective developing units 23*a*, 23*b*, 23*c* and 23*d*. Developing rollers 231*a*, 231*b*, 231*c* and 231*d* are arranged opposing respective photoreceptor drums 21*a*, 21*b*, 21*c* and 21*d*, so as to supply the associated colors of toners to the electrostatic latent images formed on the outer peripheral surfaces of photoreceptor drums 21*a*, 21*b*, 21*c* and 21*d*, respectively to visualize them.

As the toner to be supplied, toners of black (BK), yellow (Y), magenta (M) and cyan (C) colors are stored in toner supply assemblies 500*a*, 500*b*, 500*c* and 500*d*, respectively.

Here, two toner supply assemblies 500*a* for black (BK) toner are arranged side by side in order to support large-volume printing, taking into account the practice that monochrome printing is usually used most frequently.

Each toner supply assembly 500 is arranged at a position approximately directly above the developing unit 23 of the corresponding toner, and is connected to the corresponding developing unit 23 by means of a toner supply passage part 612 (612*a*, 612*b*, 612*c* or 612*d*).

Here, supply passage part 612*a* for supplying the black (BK) toner is constructed so that the toner from two toner supply devices 100*a* and 100*a* can be put together and supplied to developing unit 23*a*.

Cleaner unit 24 is arranged on the upstream side of charger 22 with respect to the rotational direction of the photoreceptor drum. Cleaner unit 24 has a cleaning blade 241 and is configured so that the cleaning blade 241 is positioned in abutment with the outer peripheral surface of photoreceptor 21 so as to scrape and collect the leftover toner off the photoreceptor drum 21. A reference numeral 242 in the drawing designates a conveying screw for conveying the collected toner.

In the present embodiment, cleaning blade 241 is used but the cleaning unit is not limited to this configuration. One or more cleaning blades may be used or a fur-brush or magnetic brush may be used alone. Alternatively, a fur-brush or magnetic brush may be used in combination with a cleaning blade. That is, any configuration may be used as long as it can scrape and collect the leftover toner off the photoreceptor drum 21.

Exposure unit 10 is mainly composed of a box-shaped housing, a laser scanning unit (LSU) 11 having a laser illuminator 11*a* incorporated therein, a polygon mirror 12 and reflection mirrors 13*a*, 13*b*, 13*c*, 13*d*, 14*a*, 14*b* and 14*c* etc. for reflecting the laser beams for associated colors.

The laser beam emitted from the laser illuminator of laser scanning unit 11 is separated into conveyance path; color components by polygon mirror 12 and an unillustrated f-θ lens, then the separated components of light are reflected by reflection mirrors 13*a* to 13*d* and 14*a* to 14*c* to illuminate the respective photoreceptor drums 21*a*, 21*b*, 21*c* and 21*d* of individual colors.

Here, concerning laser scanning unit 11, a writing head made up of an array of light emitting devices such as EL (electro luminescence), LED (light emitting diode) and others, may be used instead of the laser illuminator. Also, a light source in combination with a liquid crystal shutter may be used. That is, any configuration can be used as long as it can create an electrostatic latent image on the photoreceptor drum 21 surface.

As shown in FIG. 1, transfer belt unit 30 is essentially composed of transfer belt 31, a transfer belt drive roller 32, a transfer belt driven roller 33 and intermediate transfer rollers 35*a*, 35*b*, 35*c* and 35*d*.

In the following description, any of intermediate transfer rollers 35*a*, 35*b*, 35*c* and 35*d* will be referred to as intermediate transfer roller 35 when general mention is made.

Transfer belt 31 is formed of an endless film of about 75 μm to 120 μm thick. Transfer belt 31 is essentially made from polyimide, polycarbonate, thermoplastic elastomer alloy or the like.

Also, transfer belt 31 is tensioned by transfer belt drive roller 32, transfer belt driven roller 33 and intermediate transfer rollers 35 so that its surface comes into contact with the outer peripheral surfaces of photoreceptor drums 21, and is adapted to move in the auxiliary scan direction (in the direction of arrow B in the drawing) by the driving force of the transfer belt drive roller 32.

Transfer belt drive roller 32 is disposed at one end side of housing 1*a* and drives the transfer belt 31 by applying a driving force to transfer belt 31 whilst nipping and pressing the transfer belt 31 and a recording sheet together between itself and transfer roller 36 to convey the recording sheet.

Transfer belt driven roller 33 is disposed on the other end side of housing 1*a*, so as to suspend and tension the transfer belt 31 approximately horizontally from the fixing unit 27 side to the other end side of housing 1*a*, in cooperation with transfer belt drive roller 32. However, if the dimension in the width direction of image forming apparatus 1 in FIG. 1 needs to be smaller, that is, if the foot print is made smaller with respect to the width direction in order to achieve space-saving, the position of transfer belt drive roller 32 may be displaced so that transfer belt 31 is inclined in either way from the fixing unit 27 side to the other of housing 1*a* while the photoreceptors, developing units, laser illuminator, fixing unit and other components may be rearranged and resized as appropriate in association with that change in layout.

Intermediate transfer rollers 35 are arranged in the interior space of transfer belt 31 wound between transfer belt drive roller 32 and transfer belt driven roller 33 and positioned with their axes displaced relative to corresponding photoreceptor drums 21, in the lateral direction in the drawing, to the downstream side with respect to the moving direction of transfer belt 31, so as to press the inner surface of transfer belt 31 and bring its outer peripheral surface into contact with part of the outer peripheral surface of each photoreceptor drum 21, forming a predetermined amount of nip.

Further, intermediate transfer roller 35 is formed of a metal (e.g., stainless steel) shaft having a diameter of 8 to 10 mm and a conductive elastic material such as EPDM, foamed urethane etc., coated on the outer peripheral surface of the metal shaft. However, the configuration should not be limited to use of these elastic materials.

The thus formed intermediate transfer roller 35 is applied with a high-voltage transfer bias for transferring the toner image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

The visualized toner images (electrostatic images) formed on the photoreceptor drums 21 correspondingly to respective colors are transferred one over another on transfer belt 31, reproducing the image information that has been input to the apparatus. The thus formed laminated image information is transferred to the recording sheet by transfer roller 36 disposed at its contact point with transfer belt 31.

Transfer roller 36 as a constituent of the transfer means is a component for transferring the developer image transferred to transfer belt 31 to recording paper, and is arranged opposing transfer belt drive roller 32 at approximately the same level and in parallel thereto and pressing against the transfer belt 31 wound on the transfer belt driver roller 32, forming a predetermined nip therewith while being applied with a high voltage of a polarity (+) opposite to the polarity (−) of the static charge on the toner, for transferring the multi-color toner image formed on the transfer belt 31 to the recording paper.

In order to produce a constant nip between transfer belt 31 and transfer roller 36, either transfer belt drive roller 32 or transfer roller 36 is formed of a hard material such as metal or the like while the other roller is formed of a soft material such as elastic rubber, foamed resin, etc.

A registration roller 26 is provided under transfer belt drive roller 32 and transfer roller 36. This registration roller 26 is configured so as to deliver the recording sheet toward the transfer roller 36 side by aligning the front end of the sheet fed from paper feed portion 109 with the leading end of the toner image on transfer belt 31.

Since the toner adhering to transfer belt 31 as the belt comes in contact with photoreceptor drums 21, or the toner which has not been transferred to the recording sheet by transfer roller 36 and remains on transfer belt 31, would cause contamination of color toners at the next operation, transfer belt cleaning unit 37 is adapted to remove and collect such toner.

Transfer belt cleaning unit 37 includes: a cleaning blade 37*a*, located near transfer belt driven roller 33 and arranged so as to abut (come into sliding contact with) transfer belt 31; and a box-like toner collector 37*b* for temporarily holding the waste toner, left over on and scraped from transfer belt 31 by the cleaning blade 37*a*, to thereby scrape and collect the leftover toner off the transfer belt 31 surface.

Also, transfer belt cleaning unit 37 is arranged near process printing unit 20*a*, on the upstream side of the process printing unit 20*a* with respect to the moving direction of transfer belt 31. Further, transfer belt 31 is supported from its interior side by transfer belt driven roller 33, at the portion where cleaning blade 37*a* comes into contact with the outer surface of transfer belt 31.

Fixing unit 27 includes: as shown in FIG. 1, a pair of fixing rollers 271 consisting of a heat roller 27*a* and pressing roller 27*b*; and a conveying roller 27*c* above the fixing rollers 271. A recording sheet is input from below fixing rollers 271 and output to above conveying roller 27*c*.

Above fixing unit 27 a paper discharge roller 28 is arranged so that the recording sheet conveyed from conveying roller 27*c* is discharged by the paper discharge roller 28 to paper output tray 43.

Referring to the fixing of a toner image by fixing unit 27, a heating device (not shown) such as a heater lamp or the like, provided inside or close to heat roller 27*a* is controlled based on the detected value from a temperature detector (not shown) so as to keep heat roller 27*a* at a predetermined temperature (fixing temperature) while the recording sheet with a toner image transferred thereon is heated and pressed between heat roller 27*a* and pressing roller 27*b* as it is being conveyed and rolled thereby, so that the toner image is thermally fused onto the recording sheet.

A duplex printing paper path S3 for double-sided printing is constructed adjacent to fixing unit 27, from the rear side of fixing unit 27 downward to the vicinity of paper feed portion 109. Conveying rollers 29*a* and 29*b* are arranged at the top and bottom and along the duplex printing paper path S3, thereby the recording sheet is inverted and delivered again toward transfer roller 36.

Specifically, conveying roller 29*a* is disposed at the rear of fixing unit 27 and conveying roller 29*b* is located below conveying roller 29*a* with respect to the top and bottom direction and at approximately the same level as registration roller 26.

In the present embodiment, heat roller 27*a* using a heating means made up of a heater lamp etc., is used with pressing roller 27*b*, but an induction heating type heating means may be used alone or in combination. Further, it is not necessary to use a roller as a means for applying pressure. That is, any appropriate method can be used as long as it can uniformly fix the toner image with heat without causing any image disturbance.

Paper feed portion 109 includes a manual feed tray 41 and paper feed cassette 42 for holding recording paper to be used for image forming, and is adapted to deliver recording paper, sheet by sheet, from manual feed tray 41 or paper feed cassette 42 to image forming portion 108.

As shown in FIG. 1, manual feed tray 41 is arranged at one side end (on the right side in the drawing) of housing 1*a* of image forming apparatus 1 so that it can be unfolded outside when used and folded up to the one end side when unused. This tray delivers paper, sheet by sheet, into the housing la of image forming apparatus 1 when the user places a few recording sheets (necessary number of sheets) of a desired type.

Arranged inside housing 1*a* of image forming apparatus 1 on the downstream side with respect to the manual feed tray 41's paper feed direction of recording paper (the direction of arrow C in the drawing) is a pickup roller 41*a* at the side of exposure unit 10. A conveying roller 41*b* is also disposed at approximately the same level further downstream with respect to the paper feed direction.

Pickup roller 41*a* touches one edge part of the surface of the recording sheet that is fed from manual feed tray 41 and reliably conveys the paper, sheet by sheet, by the function of roller's frictional resistance.

The aforementioned pickup roller 41*a* and conveying rollers 41*b*, 41*c* and 41*d* constitute a recording paper conveying path S1.

On the other hand, paper feed cassette 42 is arranged under the image forming portion 108 and exposure unit 10 in housing 1*a*, so as to accommodate a large amount of recording sheets of a size specified by the specification of the apparatus or of a size that is determined beforehand by the user.

Arranged above one end side (the left-hand side in the drawing) of paper feed cassette 42 is a pickup roller 42*a*. A conveying roller 42*b* is also provided on the downstream side of the pickup roller 42*a* with respect to the pickup roller 42*a*'s paper feed direction.

Pickup roller 42*a* touches one edge part of the surface of the topmost sheet of a stack of recording sheets set on the paper feed cassette 42 in response to a printout request and reliably picks up and feeds the paper, sheet by sheet, by the function of roller's frictional resistance.

Conveying roller 42*b* conveys the recording sheet delivered from pickup roller 42*a* upward along a recording sheet feed path S2 formed on one end side inside housing 1*a* to image forming portion 108.

Next, image output by image forming apparatus 1 of the present embodiment will be described.

Image forming apparatus 1 is constructed so as to transfer the toner images formed on photoreceptor drums 21 to a recording sheet fed from paper feed portion 109 by a so-called intermediate transfer process (offset process) via transfer belt 31.

First, charger 22 uniformly electrifies the outer peripheral surface of photoreceptor drum 21 at a predetermined voltage. Each electrified photoreceptor drum 21 is irradiated with a laser beam from exposure unit 10, so that an electrostatic latent image for each color is formed on the photoreceptor drum 21 for the color.

Next, toner is supplied from developing units 23 (23*a*, 23*b*, 23*c* and 23*d*) to the outer peripheral surfaces of photoreceptor drums 21 (21*a*, 21*b*, 21*c* and 21*d*) so that the static latent images formed on the outer peripheral surfaces of photoreceptor drums 21 are visualized with toner so as to form toner images.

Then, the toner image formed on photoreceptor drum 21 is transferred to transfer belt 31.

Transfer of the toner image from photoreceptor drum 21 to transfer belt 31 is done by application of a high voltage from intermediate transfer roller 35 arranged in contact with the interior side of transfer belt 31.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presenting the opposite polarity (+). Thereby, the toner image bearing negative (−) charge on photoreceptor drum 21 is transferred to transfer belt 31 as the photoreceptor drum 21 turns and comes into contact with transfer belt 31.

The toner images of colors formed on respective photoreceptor drums 21 are transferred to transfer belt 31, laid over, one over another, in the order of yellow (Y), magenta (M), cyan (C) and black (BK) as transfer belt 31 moves to come into contact with each of the rotating photoreceptor drums 21, forming a color toner image on transfer belt 31.

In this way, the toner images developed from static latent images on photoreceptor drums 21 for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image having been transferred on transfer belt 31 is transferred from transfer belt 31 to the recording sheet by the function of transfer roller 36.

Since the toner adhering to transfer belt 31 as the belt comes in contact with photoreceptor drums 21, or the toner which has not been transferred to the recording sheet by the function of transfer roller 36 and remains on transfer belt 31, would cause contamination of color toners at the next operation, it is removed and collected by transfer belt cleaning unit 37.

Next, the operation of feeding recording sheets by paper feed portion 109 will be described.

When the recording paper placed on manual feed tray 41 is used, as shown in FIG. 1 the paper is taken in by pickup roller 41*a* from manual feed tray 41, sheet by sheet, at controlled timings in accordance with the instructions from a control panel (not shown), and fed into the machine.

The recording sheet thus taken into the machine is conveyed along recording paper feed path S1 by conveying roller 41*b* to image forming portion 108.

When the recording paper accommodated in paper feed cassettes 42 is used, the paper is separated and fed from paper feed cassette 42, sheet by sheet, by pickup roller 42*a* in accordance with a printout request and conveyed by conveying roller 42*b* along recording paper feed path S2 to image forming portion 108.

The recording sheet conveyed from manual feed tray 41 or paper feed cassette 42 is delivered to the transfer roller 36 side, by registration roller 26, at such a timing as to bring the front end of the recording sheet in register with the leading end of the toner image on transfer belt 31, so that the toner image on transfer belt 31 is transferred to the recording sheet.

The recording sheet with a toner image transferred thereon is conveyed approximately vertically and reaches fixing unit 27, where the toner image is thermally fixed to the recording sheet by heat roller 27*a* and pressing roller 27*b*.

When one-sided printing is selected, the recording sheet having passed through fixing unit 27 is discharged by discharge roller 28 and placed facedown on paper output tray 43.

In contrast, when double-sided printing is selected, the recording sheet is stopped and nipped at paper discharge roller 28, then the paper discharge roller 28 is rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed. Illustratively, the leading edge of the sheet at the first printing is directed to the trailing end when the underside is printed, or the trailing edge of the sheet at the first printing is directed to the leading end when the underside is printed.

After the toner image is transferred and thermally fixed to the underside of the recording sheet, the sheet is discharged to paper output tray 43 by paper discharge roller 28.

Thus, the transfer operation to recording paper is performed.

Next, the configuration of developing unit 23 and toner supply device 100 according to the present embodiment will be described in detail with reference to the drawings.

Figure 2:
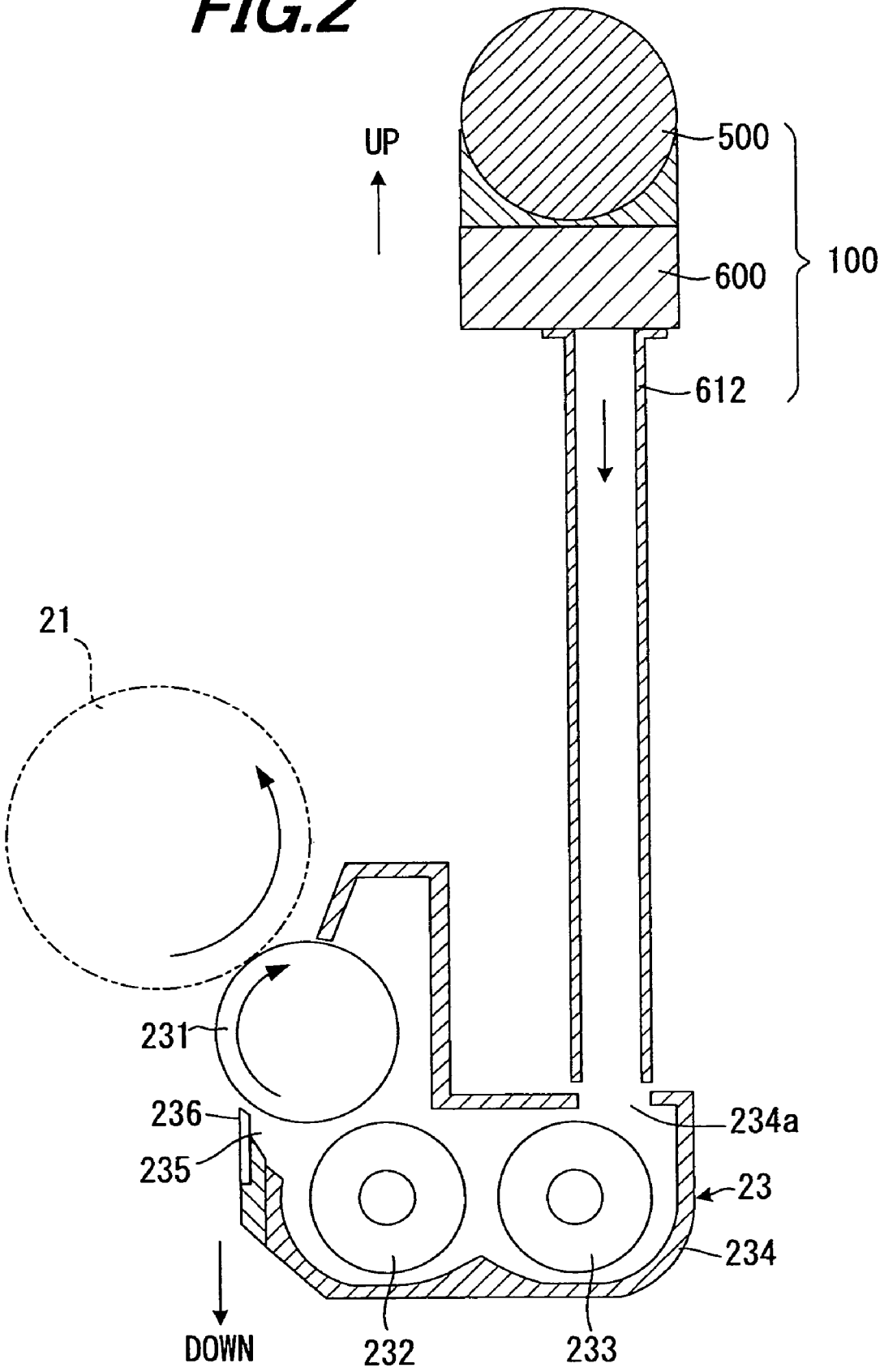
FIG. 2 is a schematic side sectional view showing a configuration of a developing unit and a toner supply device that constitute the image forming apparatus.
Figure 4:
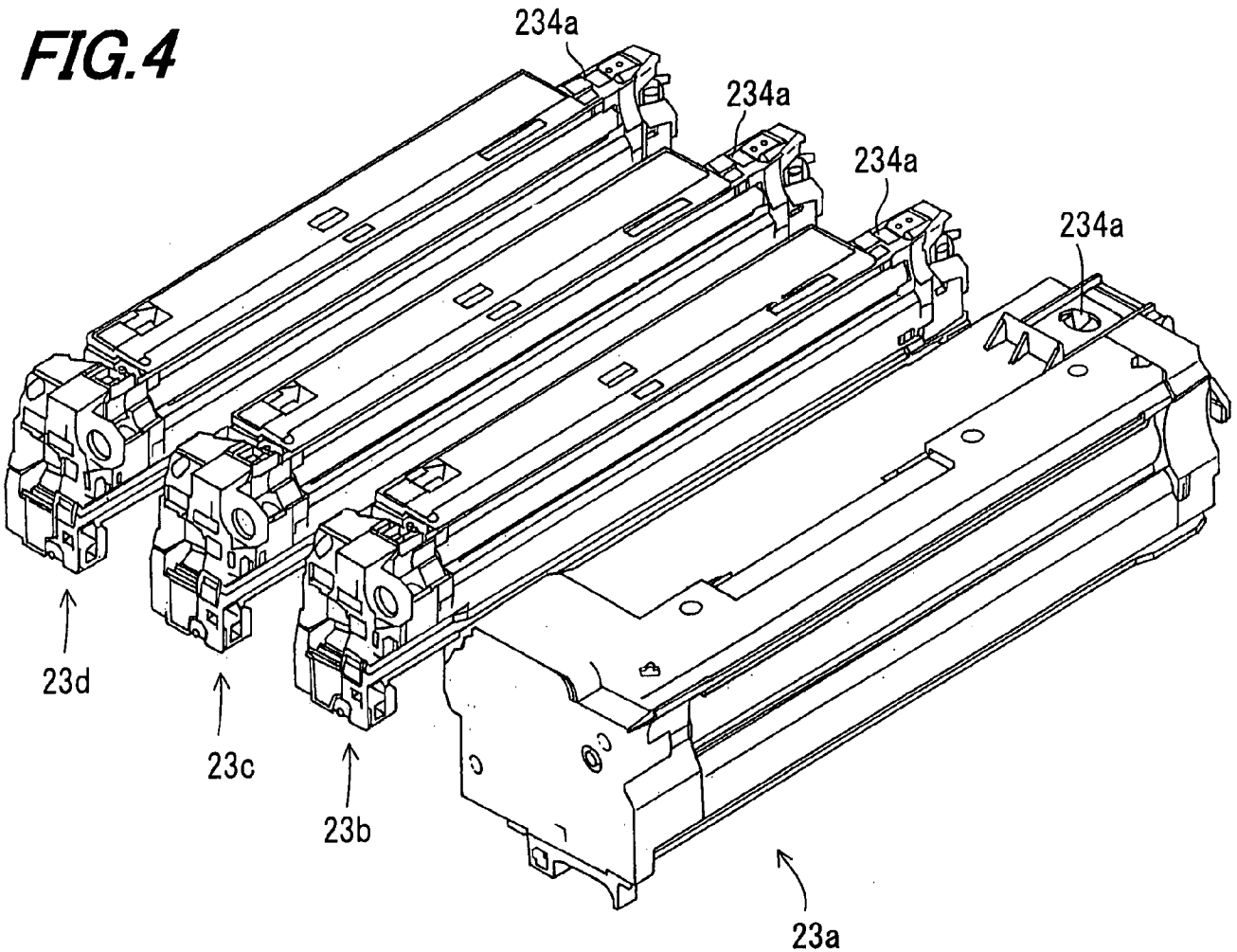
FIG. 4 is a perspective view showing the configuration of the developing unit.
Figure 5:
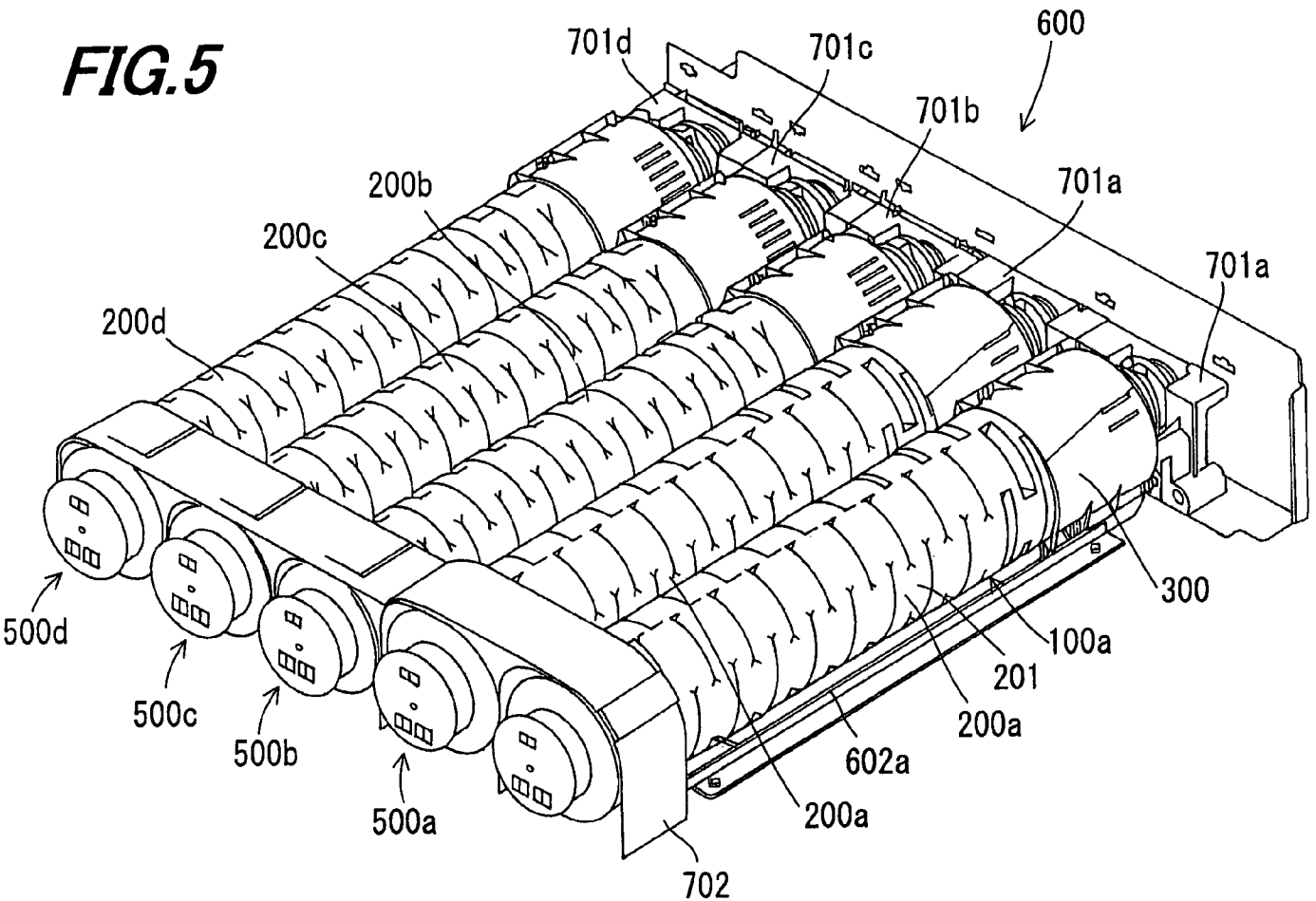
FIG. 5 is a perspective view showing amounting example when toner supply assemblies are set in toner supply assembly mounting mechanisms that constitute the toner supply devices.
Figure 6:
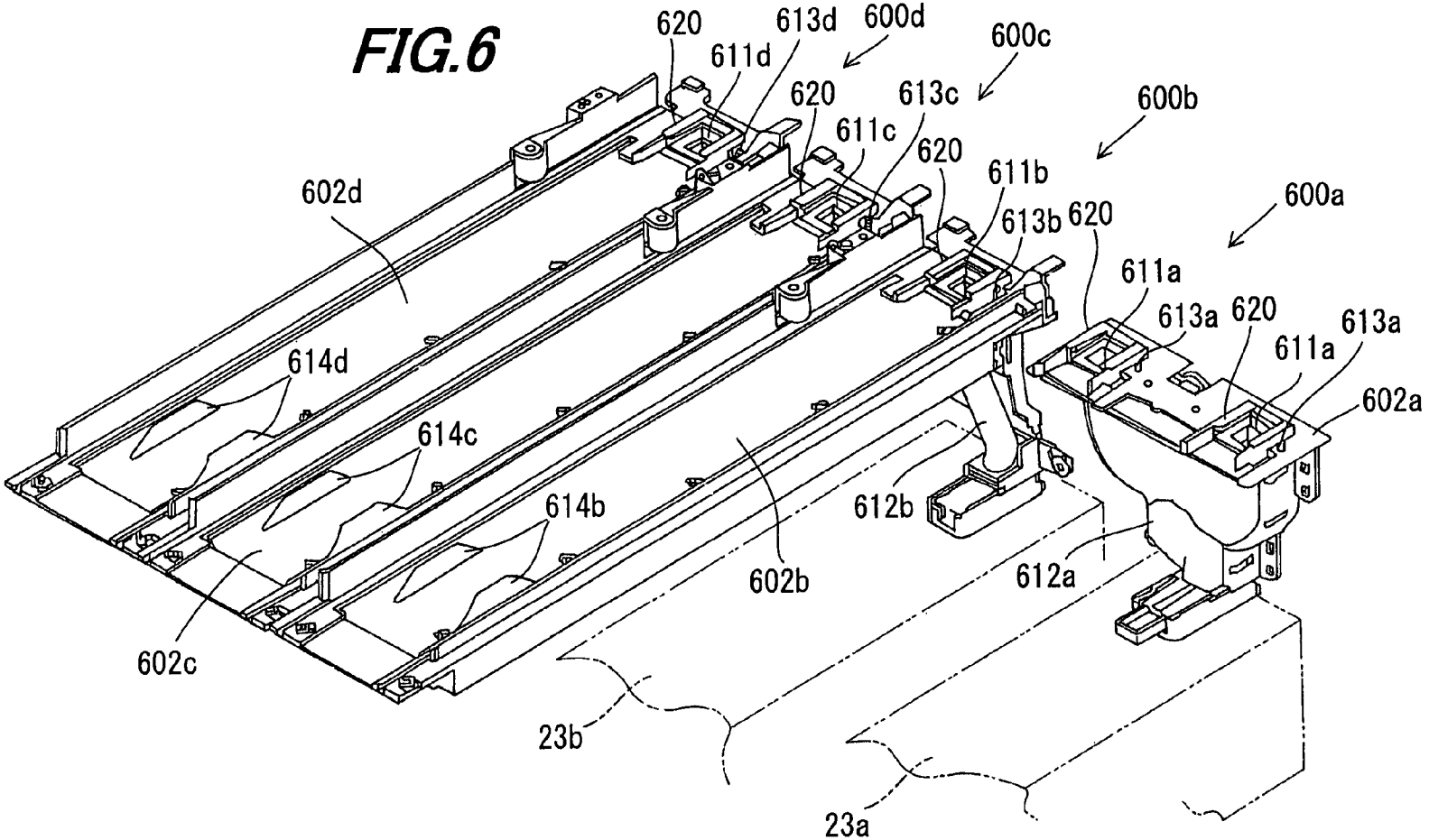
FIG. 6 is a perspective view showing the configuration of the toner supply assembly mounting mechanisms.

FIG. 2 is a schematic side sectional view showing a configuration of a developing unit and a toner supply device that constitute an image forming apparatus of the present embodiment; FIG. 3 is an overall front view showing the developing unit and toner supply device; FIG. 4 is a perspective view showing the configuration of the developing unit mounted to the image forming apparatus according to the present embodiment; FIG. 5 is a perspective view showing a mounting example when toner supply assemblies are set in a toner supply assembly mounting mechanism that constitutes the toner supply device according to the present embodiment; and FIG. 6 is a perspective view showing a configuration of the toner supply assembly mounting mechanism.

To begin with, developing unit 23 will be described.

As shown in FIGS. 2 and 3, in developing unit 23, a toner input port 234*a* for leading the toner is formed as an opening at the top of a casing 234 that forms its exterior. The developing unit incorporates inside casing 234 a developing roller 231, a first toner conveying roller 232 and a second toner conveying roller 233, and is mounted to the image forming apparatus body with the developing roller 231 opposed, in abutment with, or close to, photoreceptor drum 21. This toner input port 234*a* of developing unit 23 is formed at a position further outside of the width W of the transfer belt, on the same side as a toner feed port 611 of a toner supply assembly mounting mechanism 600 is disposed.

First toner conveying roller 232 and second toner conveying roller 233 are disposed in the bottom of casing 234 in parallel with each other along the direction of axis of developing roller 231 so that the toner that is fed into casing 234 is agitated with the developer and conveyed to developing roller 231. Developing roller 231 is arranged over and above first toner conveying roller 232 so as to be exposed from an opening mouth 235.

Casing 234 is a box-shaped configuration elongated in the direction (the width direction of the transfer belt) perpendicular to the direction of transfer (the transfer belt's direction of movement) when mounted in the image forming apparatus body, and is formed with opening mouth 235 so that developing roller 231 therein opposes photoreceptor drum 21 when developing unit 23 is mounted to the image forming apparatus body.

Opening mouth 235 is made open long across the width of casing 234 along the axis direction of developing roller 231 so that at least developing 231 will be able to oppose and abut photoreceptor drum 21. Provided along the bottom edge of opening mount 235 in the drawing is a blade 236 that extends in the axis direction of developing roller 231. Blade 236 is positioned so as to create a predetermined clearance between the blade 236 edge and the developing roller 231 surface, whereby a predetermined amount of toner can be supplied to the developing roller 231 surface through the clearance.

Arranged over the thus constructed developing unit 23 is toner supply device 100 (FIGS. 2 and 3).

Referring next to the drawings, the configurations of toner bottle 200 and toner supply device 100 according to the present embodiment will be described.

Figure 7A:
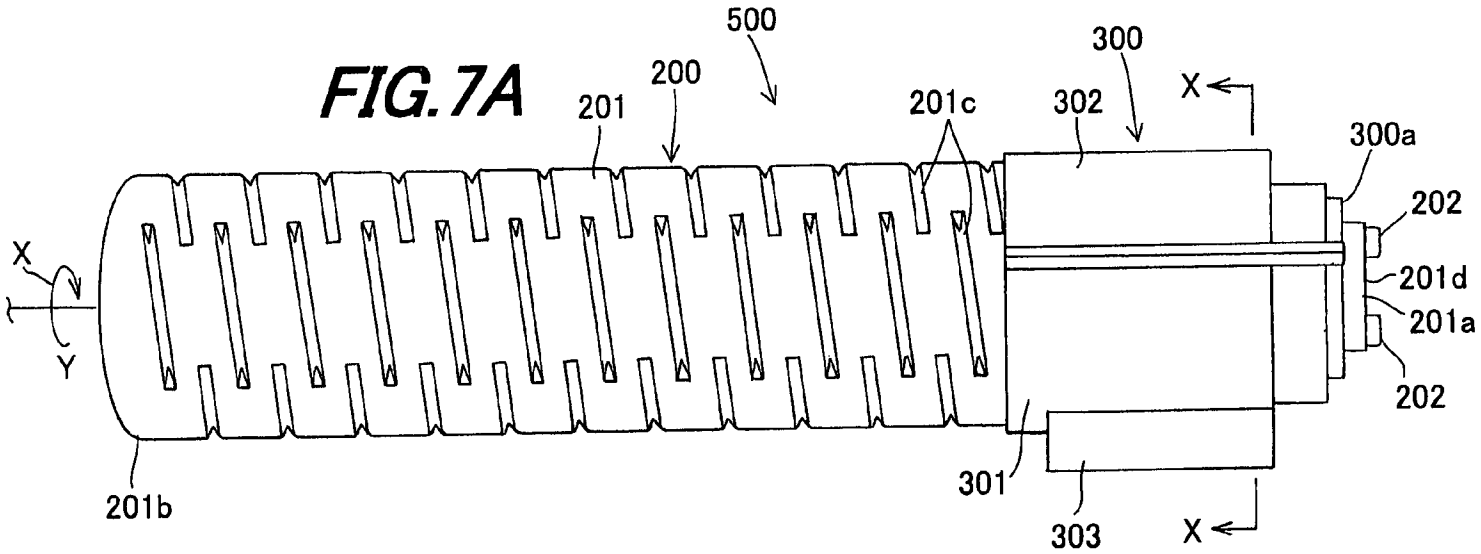
FIG. 7A is a side view showing a configuration of a toner supply assembly as a part of the toner supply device and FIG. 7B is its front view, viewed from the end face side of the toner supply assembly from which toner is supplied.
Figure 7B:
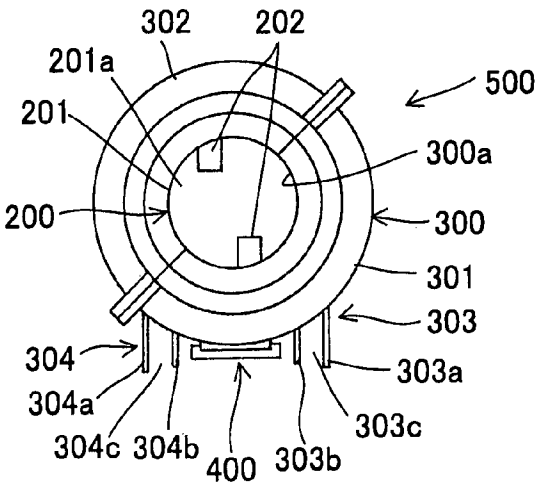
Figure 8:
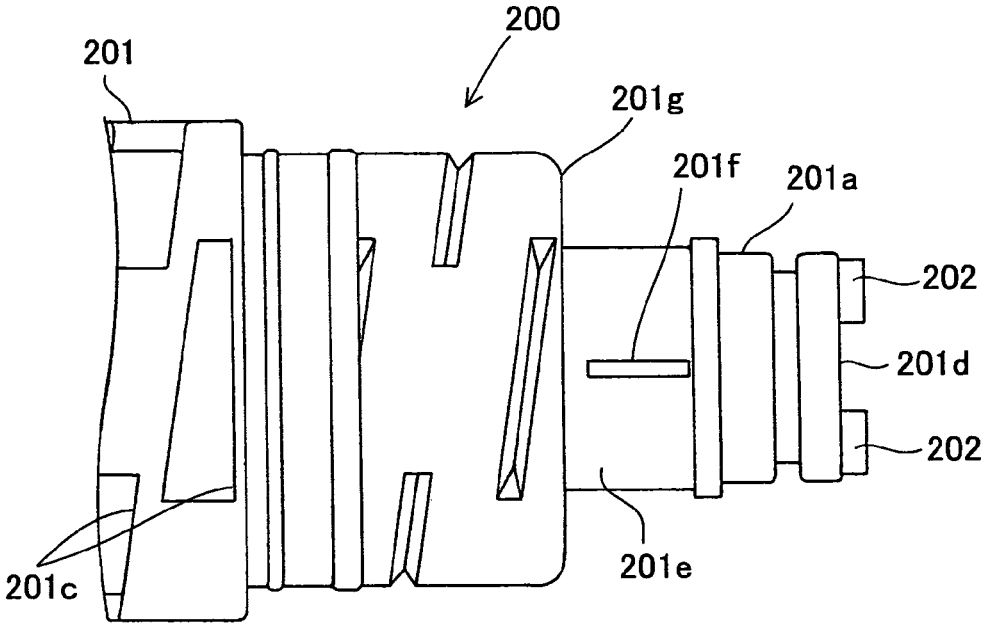
FIG. 8 is a side view of the front end part of a toner bottle as a part of the toner supply assembly.
Figure 9:
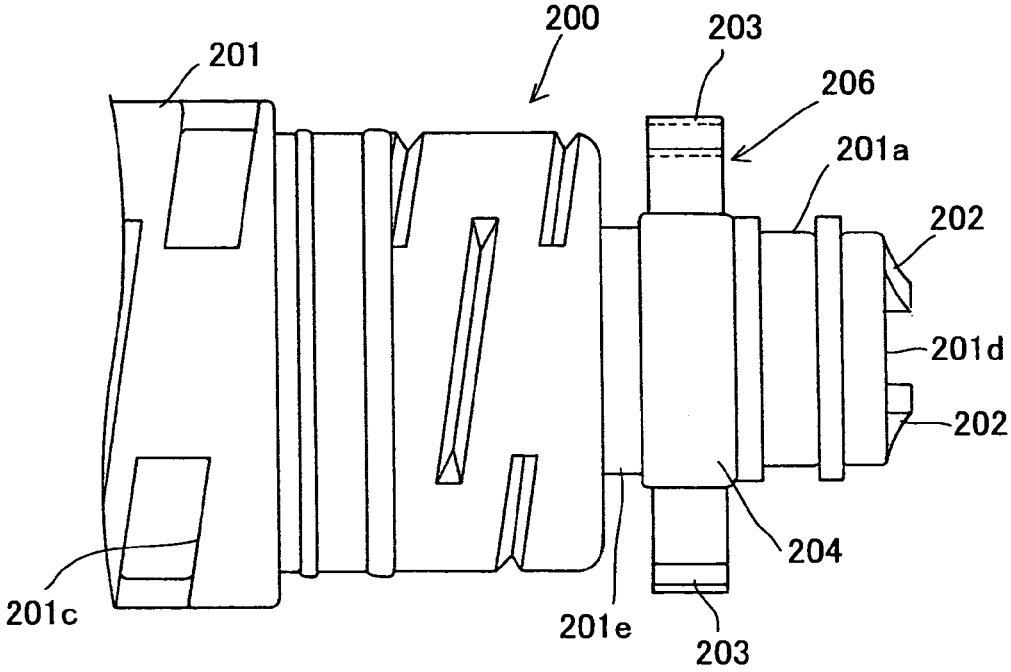
FIG. 9 is a side view showing a configuration when scrapers for toner conveyance are fitted to the front end part of the toner bottle.
Figure 10:
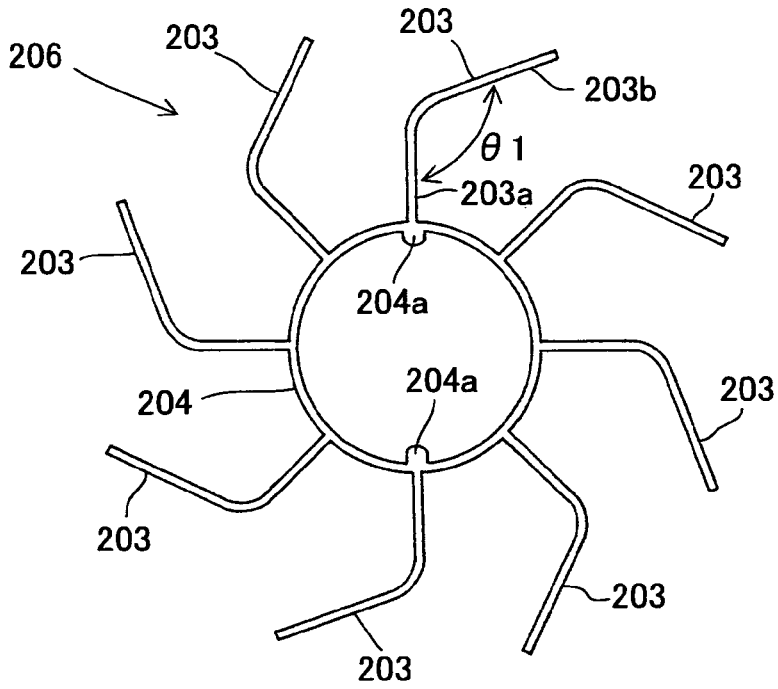
FIG. 10 is an illustrative view showing one example of the scrapers.
Figure 11:
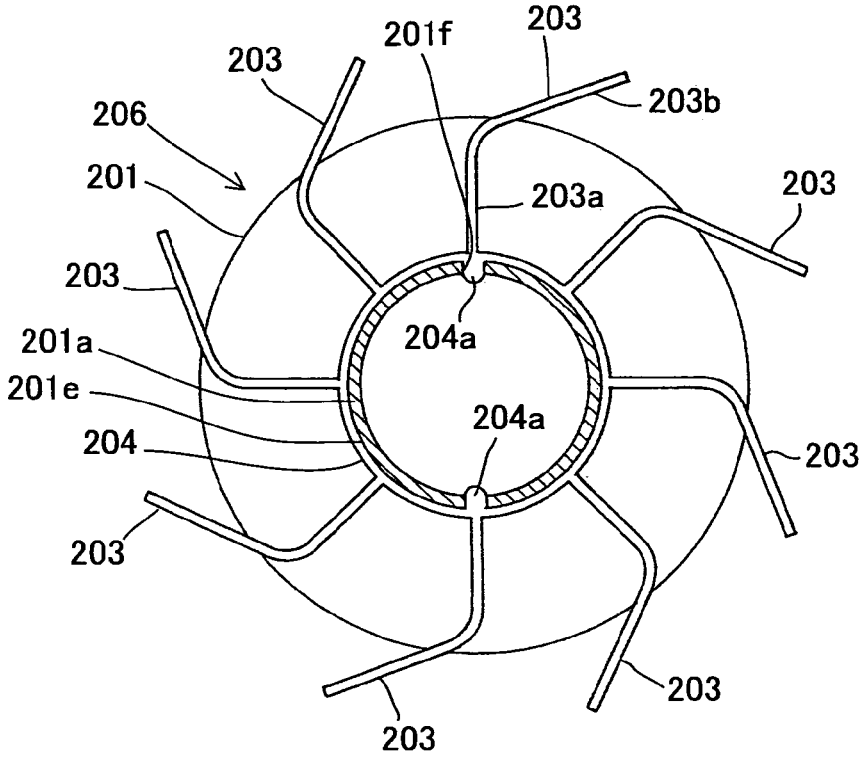
FIG. 11 is an illustrative view schematically showing a case where the scrapers are attached to the toner bottle.
Figure 12:
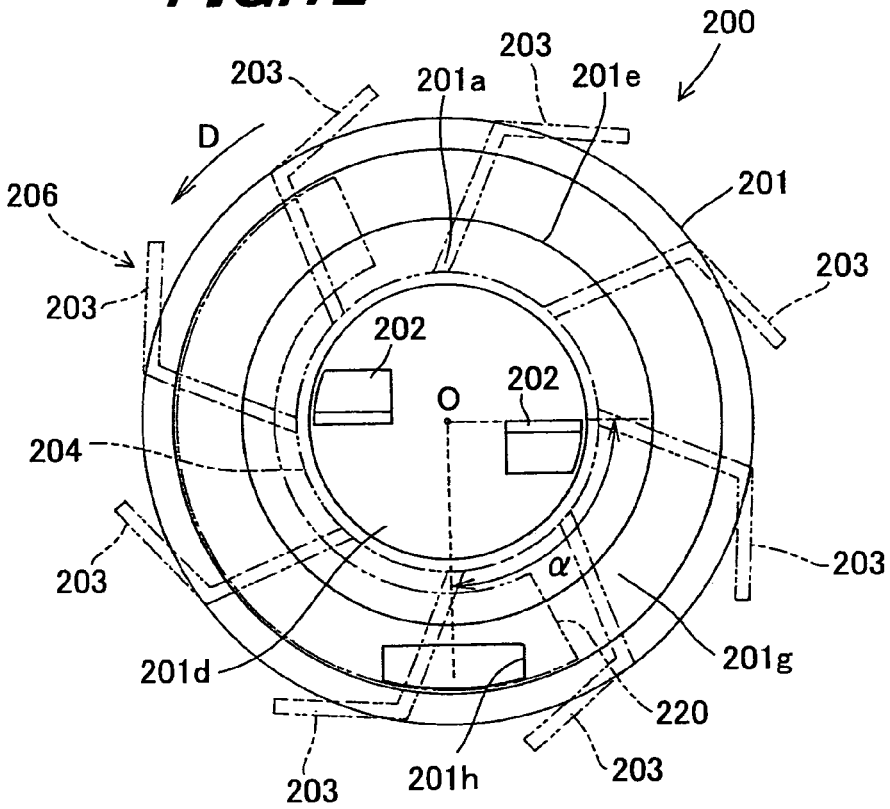
FIG. 12 is a front view showing a configuration of the toner bottle.

FIG. 7A is a side view showing a configuration of a toner supply assembly as a part of the toner supply device according to the present embodiment; FIG. 7B is a front view of the toner supply assembly, viewed from the end face side of the toner supply assembly from which toner is supplied; FIG. 8 is a side view of the front end part of a toner bottle as a part of the toner supply assembly; FIG. 9 is a side view showing a configuration when scrapers for toner conveyance are fitted to the front end part of the toner bottle; FIG. 10 is an illustrative view showing one example of the scrapers; FIG. 11 is an illustrative view schematically showing a case where the scrapers shown in FIG. 10 are fitted to the toner bottle; and FIG. 12 is a front view showing a configuration of the toner bottle.

In the present embodiment, any of toner supply assemblies 500*a*, 500*b*, 500*c* and 500*d* for respective toner supply devices 100 (100*a*, 100*b*, 100*c* and 100*d*) mounted in image forming apparatus 1 is assumed to have an identical configuration.

As shown in FIGS. 2 and 7A, toner supply device 100 is mainly composed of a toner bottle (toner container) 200 that is filled with toner as a developer, a toner supply assembly 500 having a bottle holder (toner container holder) 300 that rotatably holds the toner bottle 200 at its one end, and a toner supply assembly mounting mechanism (toner feed device) 600 to which the toner supply assembly 500 is mounted so as to feed toner to developing unit 23.

Provided on the bottom of bottle holder 300 (the lower side when toner supply device 100 is mounted in image forming apparatus 1) is a shutter mechanism 400 for opening and closing an aftermentioned toner discharge port for discharging the toner fed from toner bottle 200 to the outside of bottle holder 300, as shown in FIG. 7B.

Illustratively, when the toner discharge port of bottle holder 300 is opened by shutter mechanism 400, the toner discharge port and supply passage part 612 as a part of toner supply assembly mounting mechanism 600 are connected to each other so that the toner supplied from toner bottle 200 is fed to developing unit 23 by way of supply passage part 612 that is connected to developing unit 23.

To begin with, toner bottle 200 which is the characteristic part in the present embodiment will be described.

As shown in FIG. 7A, toner bottle 200 is comprised of a main part 201 having an approximately cylindrical shape.

When the end of main part 201 on the side supported by bottle holder 300 is called a front end part 201*a*, this front end part 201*a* is formed with an opening (described later) for discharging toner. The other end of main part 201 on the opposite side from front end part 201*a*, namely, rear end 201*b* is closed.

Formed on the peripheral side of main part 201 are a plurality of slots 201*c* which are depressed towards the rotational axis X. Here, on the interior side of main part 201, the parts corresponding to slots 201*c* form ribs that are projected towards the rotational axis X.

The grooves formed between these ribs function as guide grooves for guiding the toner stored in main part 201 from rear end 201*b* toward front end part 201*a*.

Herein, slots 201*c* are spirally formed as shown in FIG. 7A or inclined so that they move toward front end part 201*a* when main part 201 rotates about the rotational axis X clockwise viewed from the front end side (in the Y-direction). With this configuration, as toner bottle 200 rotates in the Y-direction, the toner held in the toner bottle 200 can be conveyed from rear end 201*b* to front end part 201*a* of main part 201.

Here, slots 201*c* may have any shape as long as they can convey the toner stored in main part 201 from rear end 201*b* toward front end part 201*a*.

As shown in FIG. 8, front end part 201*a* is formed to be a cylindrical shape having a smaller diameter than that of the central part of main part 201. A pair of ribs 202, 202 are projected outward from the front end face 201*d* of front end part 201*a*.

These ribs 202, 202 are engaged with an actuator of an unillustrated drive when toner supply device 100 is mounted to image forming apparatus 1. With this arrangement, a drive force from the actuator is transferred by way of ribs 202 and 202 to toner bottle 200 of toner supply device 100 to rotate it.

As shown in FIGS. 9 and 10, peripheral surface 201*e* of front part end 201*a* is formed with a toner conveying means 206 which is constructed of a plurality of scrapers (toner conveyors) 203 for conveying toner and a fixing member (toner conveyor attachment) 204 on which scrapers 203 are integrally fixed.

The scrapers 203 are each formed of a plate-like elastic resin such as rubber etc, and arranged approximately radially outwards and equi-angularly at eight positions on the peripheral surface of fixing member 204, as shown in FIGS. 10 to 12. Each scraper 203 is formed in an approximately open-V section with its free end side bent to the upstream side (to the rear) with respect to the rotational direction (the direction indicated by arrow D in FIG. 12) of toner bottle 200.

In the present embodiment, the part of scraper 203, extending radially from fixing member 204 functions as a toner conveying portion 203*a* and the part that is flexed to the upstream side (rear side) with respect to the rotational direction of toner bottle 200 functions as a lid portion 203*b*.

Figure 17A:
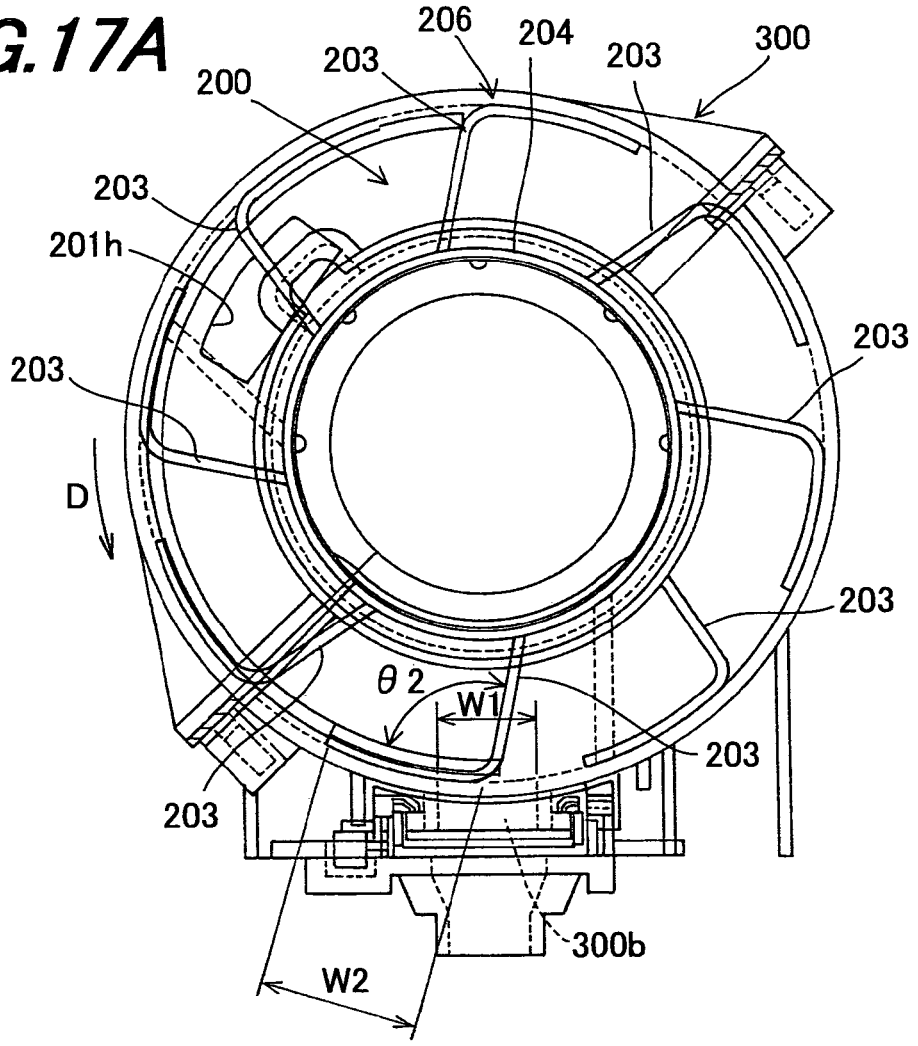
FIG. 17A is a front view showing a configuration of a bottle holder that constitutes the toner supply device.
Figure 17B:
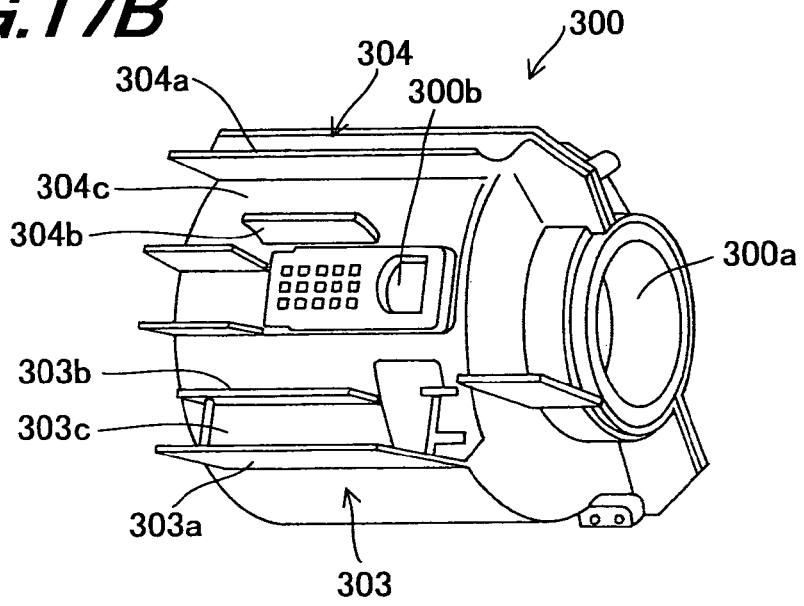
FIG. 17B is a perspective view showing the bottle holder, when it is viewed from the rear side.

Toner conveying portion 203*a* is formed longer than the size of the toner conveyance space in bottle holder 300, so that, when toner conveying means 206 fitted on toner bottle 200 is assembled inside bottle holder 300 the free end side of the scraper is tilted to the upstream side (rearwards) with respect to the toner bottle's direction of rotation (see FIGS. 17A and 17B).

This arrangement is aimed at scraping out the toner that is accumulated in toner discharge chamber 300*d* (FIG. 19) without leftover. However, if the length of toner conveying portion 203*a* of scraper 203 is too long, its friction with the inner peripheral surface of bottle holder 300 becomes greater, causing increase in rotational load. Accordingly, it is preferred that the length of the toner conveying portion is set at a size that will not cause sharp increase of the rotational load.

Lid portion 203*b* is formed so that the length W2 that comes into sliding contact with the inner peripheral surface of bottle holder 300 is longer than the opening length W1 of toner discharge port 300*b*. That is, lid portion 203*b* is constructed so as to completely cover the opening of toner discharge port 300*b* when it opposes toner discharge port 300*b* (see FIGS. 17A and 17B).

The opening angle between toner conveying portion 203*a* and lid portion 203*b* is set so that $\theta 1 > \theta 2$, where $\theta 1$ is the angle when scraper 203 shown in FIG. 10 is set free and $\theta 2$ is the angle when scraper 203 is assembled inside bottle holder 300 (FIG. 17A). The difference in opening angle makes it possible to bring lid portion 203*b* into close contact with toner discharge port 300*b* by the repulsive force of scraper 203.

Fixing member 204 has an annular shape, made up of a material having elasticity (a general elastic resin such as rubber etc.), having an inside diameter marginally smaller than the outside diameter of front end part 201*a* (FIG. 9) and being formed with projections 204*a* (FIG. 10) on the inner peripheral surface thereof as shown in FIG. 10.

These projections 204*a* are adapted to fit into cutouts 201*f* that are previously formed on the front end part 201*a*, as shown in FIG. 11.

In the present embodiment, use of this fixing member 204 makes it simple to arrange scrapers 203 on main part 201 by enlarging the ring part slightly and setting it on peripheral surface 201*e* (FIG. 8) of front end part 201*a*. Moreover, it is possible to reliably fix fixing member 204 to front end part 201*a* by fitting protections 204*a* of fixing member 204 into cutouts 201*f* formed on peripheral surface 201*e* of front end part 201*a*. That is, this arrangement enables fixing member 204 to be driven integrally with front end part 201*a* without it running idly over peripheral surface 201*e* of front end part 201*a*.

Here, scrapers 203 may be directly provided on peripheral surface 201*e* of front end part 201*a*.

Formed on an end face 201*g* that forms a step with front end part 201*a* in main part 201 is a bottle-side toner discharge port 201*h* for discharging the toner held in main part 201, as shown in FIG. 12.

Here, in the present embodiment, this bottle-side toner discharge port 201*h* is formed in an essentially rectangular shape, but the opening of the discharge port should not be limited to this and may have an approximately square-shaped, polygonal, circular or any other shaped configuration as long as it will not hinder discharge of toner.

Further, as shown in FIG. 12, scraper 203 is adjusted and positioned at a predetermined angle $\alpha$ with the center of bottle-side toner discharge port 201*h* when fixing member 204 is attached to the bottle.

Here, scrapers 203 are preferably disposed at positions so as not to disturb toner discharge from bottle-side toner discharge port 201*h*. As long as this condition is satisfied, any angle can be selected as angle $\alpha$. In order to reliably prevent failures of toner discharge from bottle-side toner discharge port 201*h*, angle $\alpha$ is preferably set at 90 deg.

The toner discharged from bottle-side toner discharge port 201*h* is collected inside bottle holder 300 that is provided so as to cover front end part 201*a*. Bottle holder 300 is formed with a toner discharge port (which will be described later) for discharging the collected toner.

As shown in FIG. 12, bottle-side toner discharge port 201*h* is temporarily closed by a sealing element 220 directly before the operation of supplying toner to developing unit 23 is started as toner bottle 200 rotates.

Sealing element 220 is formed of a flexible material and is configured so that it peels off toner bottle 200 by rotation of the toner bottle 200 to thereby release bottle-side toner discharge port 201*h*.

Now, sealing element 220 will be described in detail with reference to the drawings.

Figure 13:
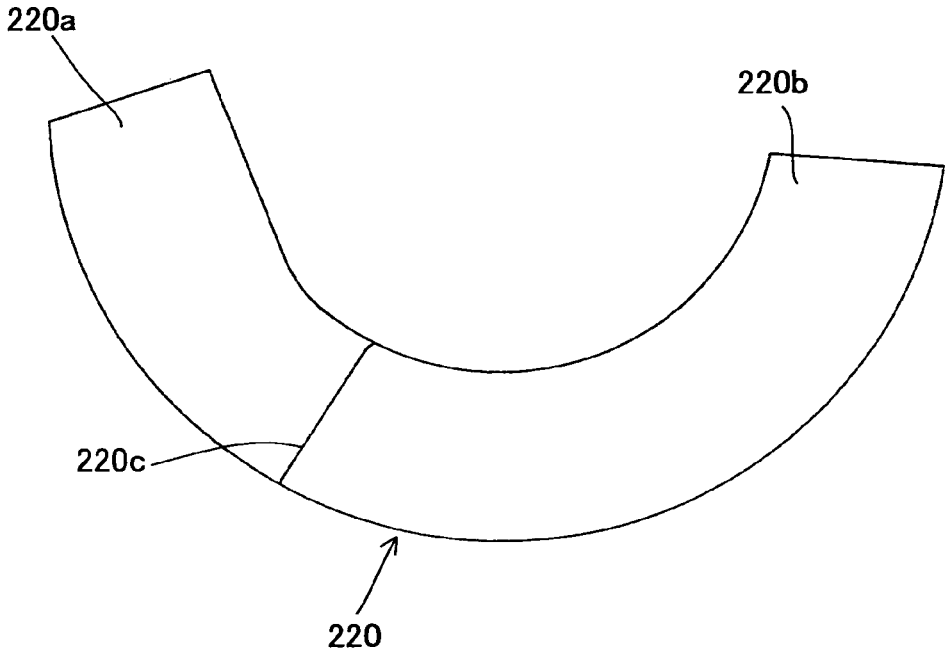
FIG. 13 is an illustrative view showing a configuration of a sealing element that closes a bottle-side toner discharge port of a toner bottle.
Figure 14A:
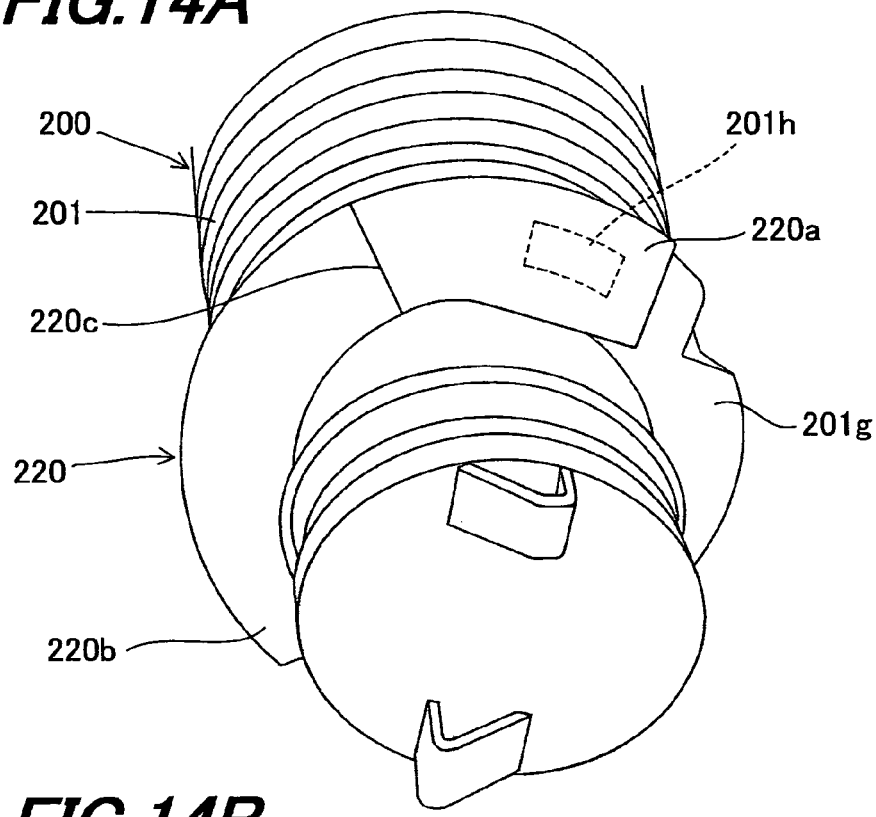
FIG. 14A is an illustrative view showing a state when the sealing element is fitted to the toner bottle.
Figure 14B:
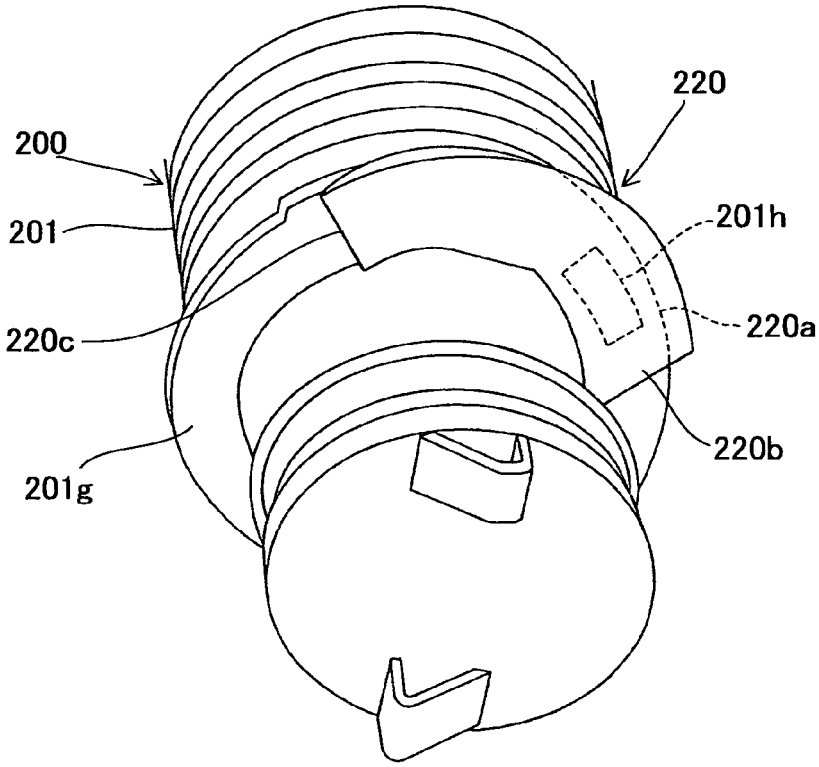
FIG. 14B is an illustrative view showing a state when the sealing element has been folded.
Figure 15:
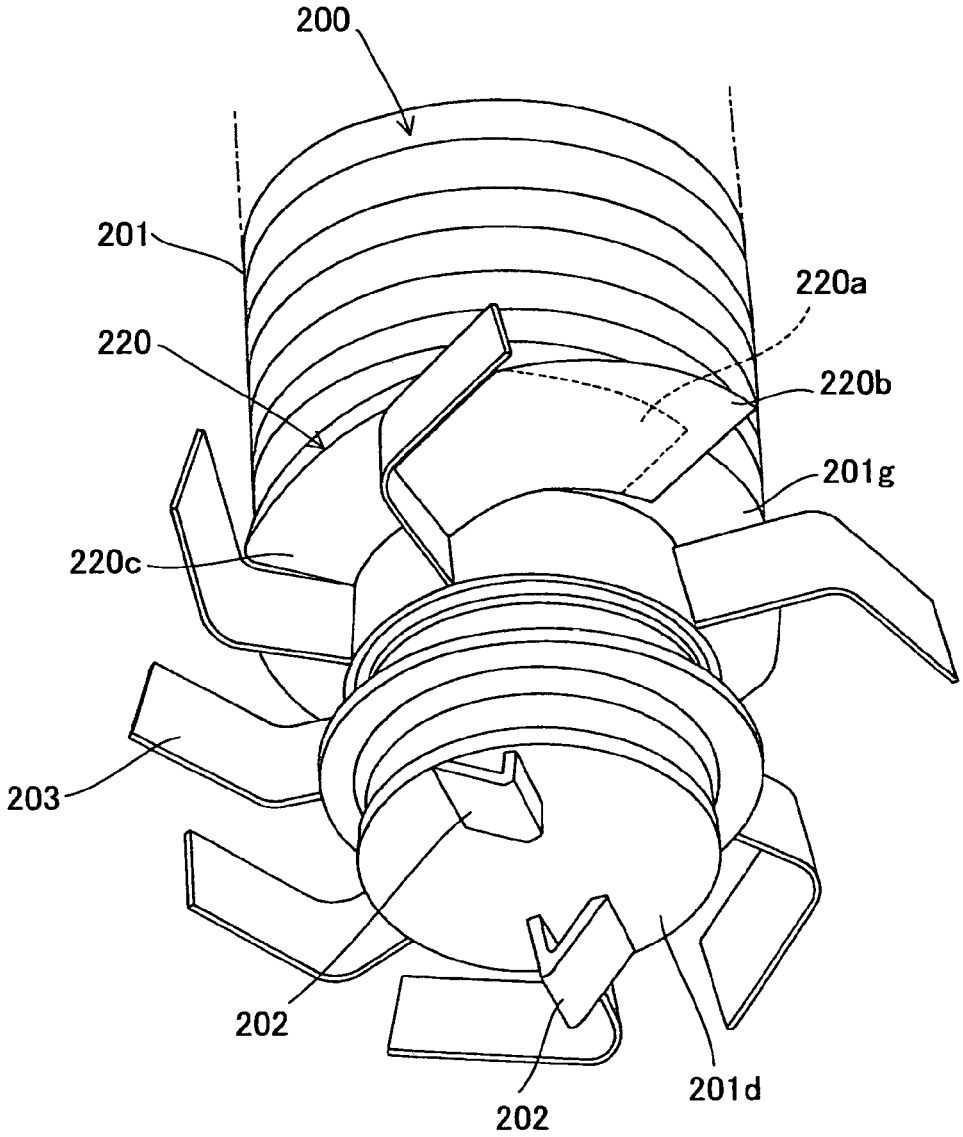
FIG. 15 is an illustrative view showing the positional relationship between the sealing element and scrapers.
Figure 16:
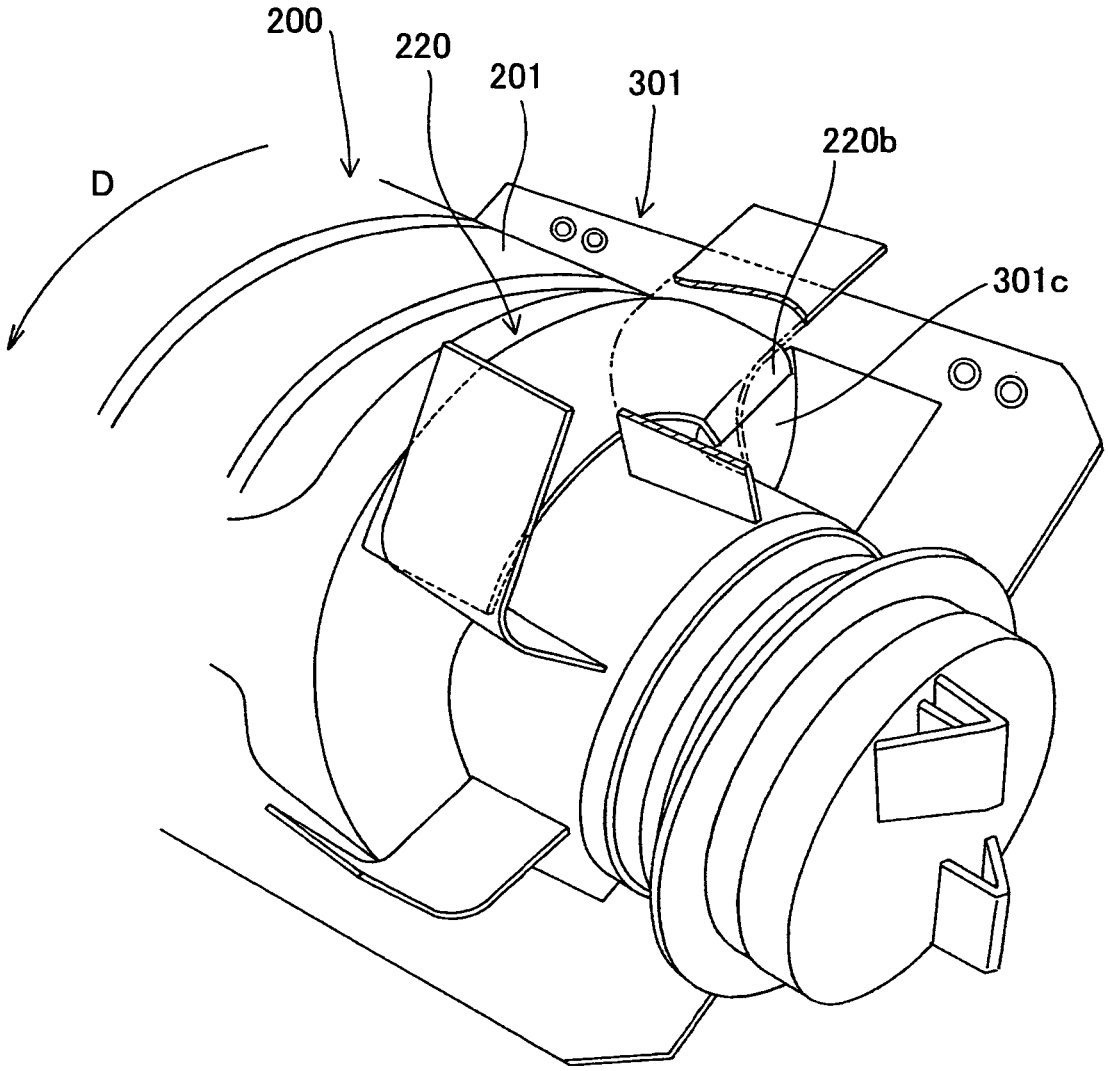
FIG. 16 is an illustrative view showing a state where the sealing element has been fitted to a bottle holder.

FIG. 13 is an illustrative view showing a configuration of a sealing element that closes a bottle-side toner discharge port of a toner bottle according to the present embodiment; FIG. 14A is an illustrative view showing a state when the sealing element is fitted to the toner bottle; FIG. 14B is an illustrative view showing a state when the sealing element has been folded; FIG. 15 is an illustrative view showing the positional relationship between the sealing element and scrapers; and, FIG. 16 is an illustrative view showing a state where the sealing element has been fitted to a bottle holder.

Sealing element 220 is formed of a product of DuPont Kabushiki Kaisha "Tyvek (R)", a felt made of extra fine polyethylene fibers, which is air-permeable and presents good slidability. The sealing element is, as shown in FIGS. 13 and 14A, B, is formed in an approximately arc shape having a predetermined width and covering an angular range of about 180 degrees along the toner bottle's peripheral direction over end face 201*g* of toner bottle 200 on which bottle-side toner discharge port 201*h* is formed.

As shown in FIG. 14A, sealing element 220 is arranged so that its first end 220*a* is bonded to end face 201*g* of toner bottle 200 and covers and seals bottle-side toner discharge port 201*h* while second end 220*b* is bonded to an aftermentioned wall portion 301*c* (FIGS. 16 and 18A) formed inside bottle holder 300.

Further, as shown in FIG. 14B, sealing element 220 is laid out between end face 201*g* and scrapers 203 as shown in FIG. 15 and folded at the approximate center of the arc over end face 201*g* of toner bottle 200 so that its fold 220*c* is located on the downstream side (front side) of the folded second end 220*b* with respect to the toner bottle's direction of rotation.

Sealing element 220's first end 220*a* that is bonded to the toner bottle 200 side is adhered to toner bottle 200's end face 201*g* by thermal fusing heat seal while second end 220*b* that is bonded to the bottle holder 300 side is adhered to wall portion 301*c* of bottle holder 300 with an adhesive such as double-sided tape. The adhesive strength with which second end 220*b* is adhered to the bottle holder 300 side is specified to be greater than the adhesive strength with which first end 220*a* is adhered to the toner bottle 200 side.

Second end 220*b* of sealing element 220 is fixed to bottle holder 300 by making an acute angle to the wall portion 301*c*, as shown in FIG. 16.

With this arrangement, when sealing element 220 is peeled off by rotation of toner bottle 200, toner bottle 200 turns in the direction of arrow D, and second end 220*b* of sealing element 220 is pulled in the direction along the wall portion 301*c*, thus second end 220*b* is adapted to be unlikely peeled off wall portion 301*c*.

On the other hand, since first end 220*a* of sealing element 220 is pulled in the direction approximately 180 degrees opposite to end face 201*g* of toner bottle 200, first end 220*a* is easy to be peeled off end face 201*g*.

With the above operation, since first end 220*a* can be easily peeled off end face 201*g* of toner bottle 200 while second end 220*b* that is bonded to wall portion 301*c* of bottle holder 300 will not come off, it is possible to easily peel sealing element 220, hence simply open bottle-side toner discharge port 201*h* by rotating toner bottle 200.

Further, since sealing element 220, after it has been separated from toner bottle 200, remains bonded and fixed at its second end 200*b* to wall portion 301*c* of bottle holder 300, the sealing element is adapted to stay in the interior space enclosed by bottle holder 300.

In the present embodiment, since first end 220*a* of sealing element 220 is bonded to end face 201*g* of toner bottle 200 by thermal fusing, bottle-side toner discharge port 201*h* can be sealed efficiently in a reliable manner with sealing element 220 and also the seal can be peeled off without leaving any adhesive.

In this way, it is possible to prevent an overloaded drive torque from being needed for rotation of toner bottle 200 and occurrence of the drive being locked and other accidents, which would occur due to hindrance to rotation of toner bottle 200 when toner builds up over the peeled surface of sealing element 220 on which sticky adhesives have been left over.

Next, bottle holder 300 will be described in detail with reference to the drawings.

Figure 18A:
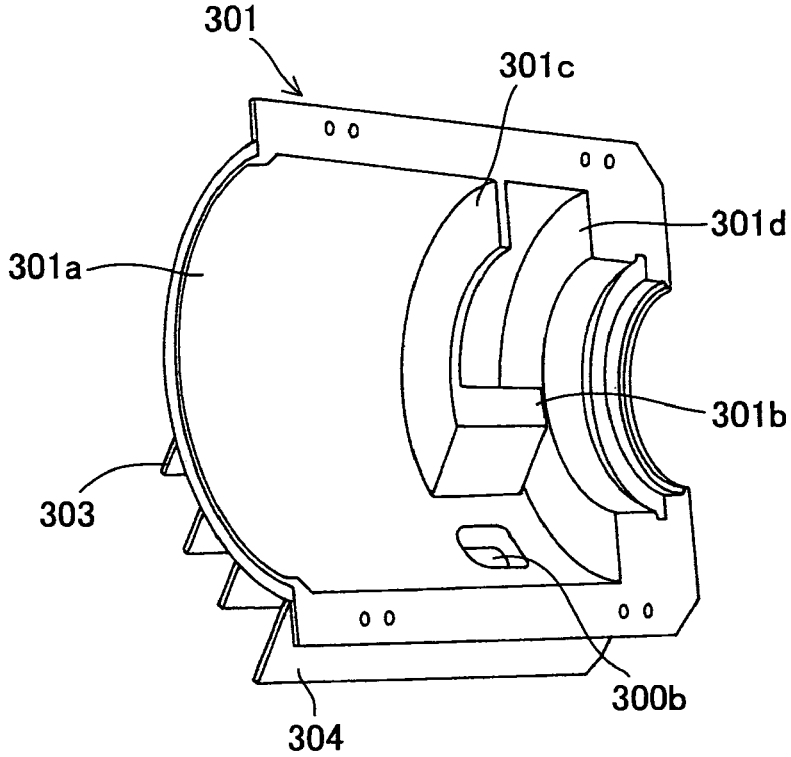
FIG. 18A is a perspective view showing a first casing that constitutes the bottle holder.
Figure 18B:
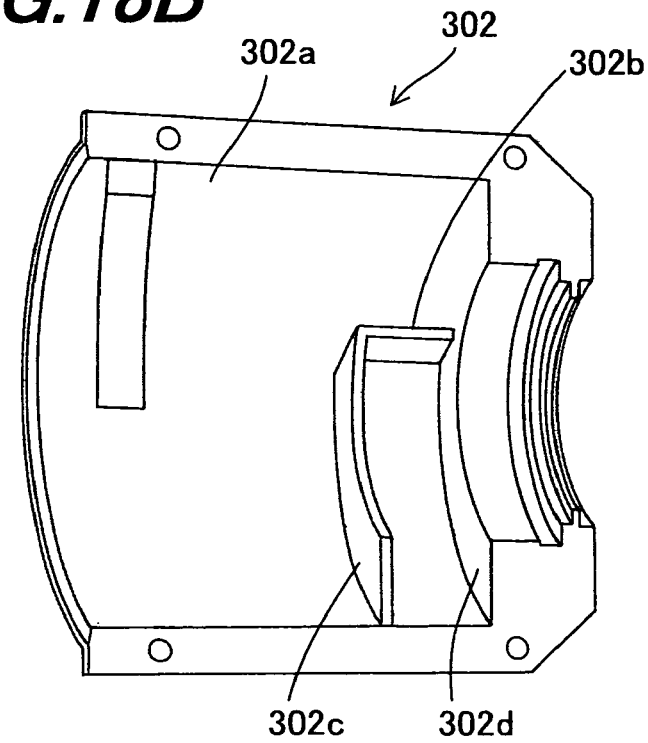
FIG. 18B is a perspective view showing a second casing that constitutes the bottle holder.
Figure 19:
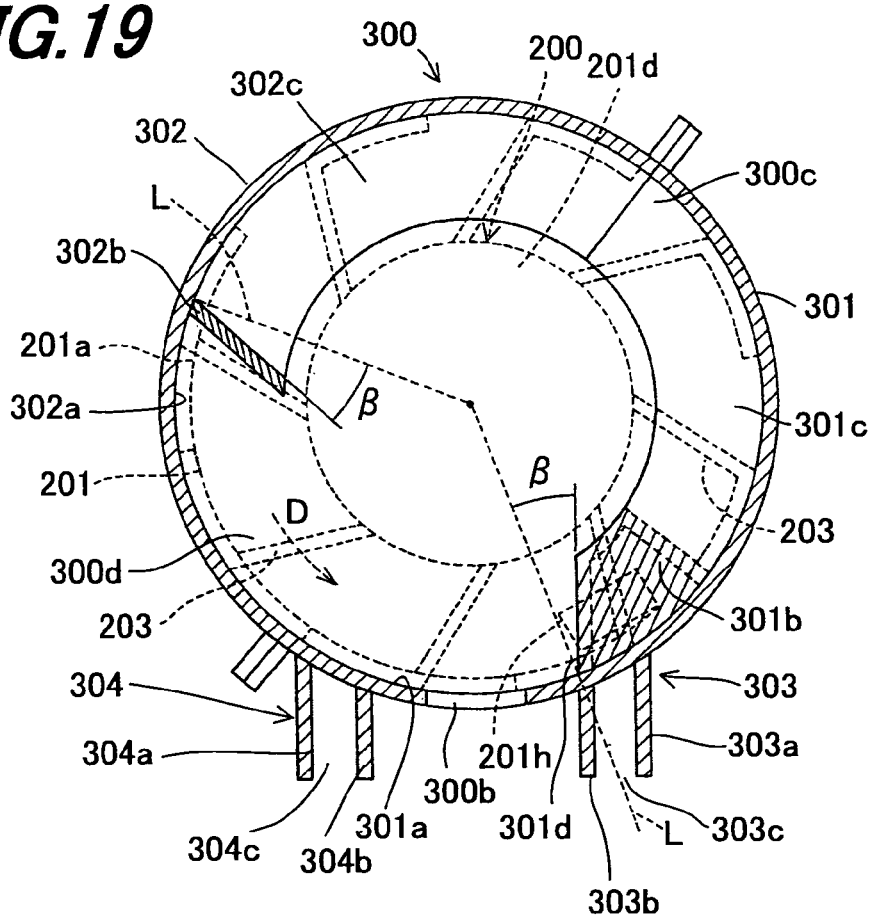
FIG. 19 is an illustrative view showing a positional relationship between a toner discharge chamber of the bottle holder and scrapers of the toner bottle.
Figure 20:
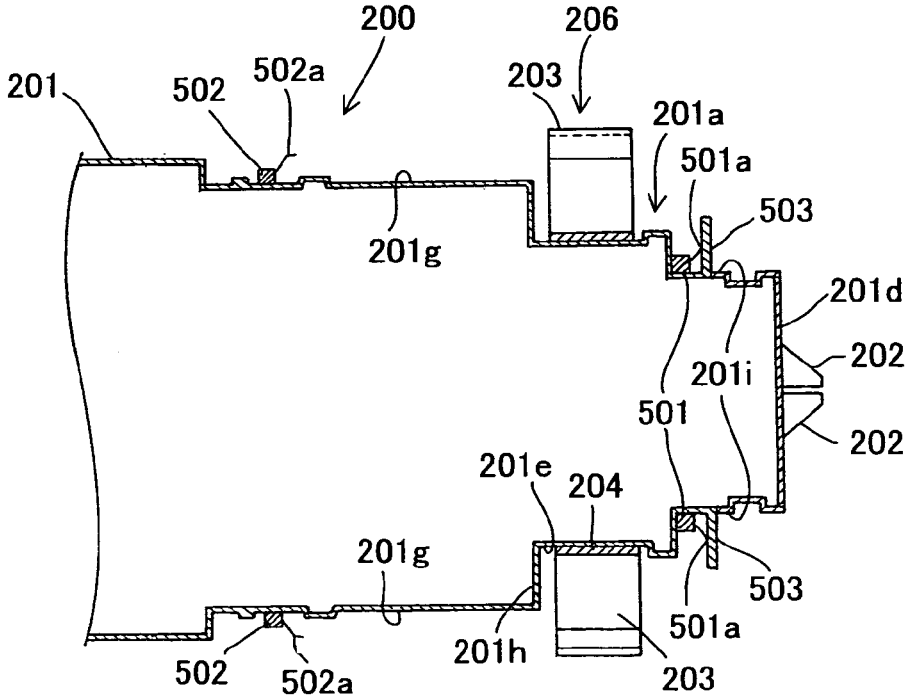
FIG. 20 is a schematic sectional view showing a configuration of the front end part of the toner bottle.

FIG. 17A is a front view showing a configuration of a bottle holder that constitutes a toner supply device according to the present embodiment; FIG. 17B is a perspective view showing the bottle holder, when it is viewed from the rear side; FIG. 18A is a perspective view showing a first casing that constitutes the bottle holder; FIG. 18B is a perspective view showing a second casing that constitutes the bottle holder; FIG. 19 is an illustrative view showing a positional relationship between a toner discharge chamber of the bottle holder and scrapers of the toner bottle; and FIG. 20 is a schematic sectional view showing a configuration of the front end part of the toner bottle.

As shown in FIGS. 7A and 7B, bottle holder 300 has an approximately cylindrical configuration, and is composed of a first casing 301 and second casing 302, joined to each other so as to cover front end part 201*a* of main part 201. At the end of the bottle holder 300 an opening 300*a* is formed so as to expose at least ribs 202 which are disposed at front end face 201*d* of front end part 201*a*.

Formed on the exterior of first casing 301 are a pair of plate-like first and second fixing structures (guide portions) 303 and 304 arranged parallel to each other, for fixing toner supply device 100 to image forming apparatus 1. Shutter mechanism 400 for controlling discharge of toner fed from toner supply device 100 to the outside is arranged between these first and second fixing structures 303 and 304.

Accordingly, in order to make shutter mechanism 400 function correctly, the height of first and second fixing structures 303 and 304 is adjusted so as to assure a clearance between bottle holder 300 and image forming apparatus 1.

Further, in first fixing structure 303, a pair of rib pieces 303*a* and 303*b* are arranged a predetermined distance apart from one another, forming a guide portion 303*c* extending in the axial direction of toner bottle 200. Also in second fixing structure 304, a pair of rib pieces 304*a* and 30*b* are arranged similarly, forming a guide portion 304*c* along the axial direction.

As shown in FIGS. 17A and 17B, bottle holder 300 has toner discharge port 300*b* formed on the bottom side of first casing 301 between first fixing structure 303 and second fixing structure 304. This toner discharge port 300*b* is adapted to be opened and closed by shutter mechanism 400.

As shown in FIG. 18A, in first casing 301, a first dam portion 301*b* for holding back the toner is formed near the aforementioned toner discharge port 300*b* on the inner peripheral surface, designated at 301*a* and a wall portion 301*c* is extended from this first dam portion 301*b* toward the side opposite to toner discharge port 300*b*. This wall portion 301*c* is arranged a predetermined distance apart from one end face or abutment surface 301*d* inside first casing 301. This distance is specified to be marginally greater than the width of the aforementioned scrapers 203.

Similarly to the first casing 301, second casing 302 is constructed as shown in FIG. 18B so that a second dam portion 302*b* for holding back the toner is formed on the inner peripheral surface, designated at 302*a* and a wall portion 302*c* is extended from this second dam portion 302*b*. This wall portion 302*c* is arranged a predetermined distance apart from one end face or abutment surface 302*d* inside second casing 302. This distance is specified to be marginally greater than the width of the aforementioned scrapers 203.

Joining first casing 301 and second casing 302 constitute the bottle holder 300 as shown in FIG. 17B.

When first casing 301 and second casing 302 are joined, a first space 300*c* is defined by enclosure of first dam portion 301*b* of first casing 301, second dam portion 302*b* of second casing 302, wall portions 301*c* and 302*c*, as shown in FIG. 19.

In the present embodiment, this first space 300*c* is referred to as a toner discharge control chamber for limiting discharge of toner, while the space other than the first space (second space), between first dam portion 301*b* and second dam portion 302*b*, is designated at 300*d* and referred to as a toner discharge chamber, which functions to discharge the toner from toner bottle 200 after its temporal storage.

Toner discharge control chamber 300*c* is not a space from which toner is actually discharged, but functions as a space for allowing scraper 203 that has come over first dam portion 301*b* to pass therethrough. In this case, though some toner which has ridden over first dam portion 301*b* with scrapers 203 exists in toner discharge control chamber 300*c*, this toner will be scraped out from the second dam portion 302*b* side by rotational movement of scrapers 203.

On the other hand, toner discharge chamber 300*d* functions as a space for temporarily storing the toner discharged from bottle-side toner discharge port 201*h* of toner bottle 200.

Here, first dam portion 301*b*'s abutment 301*d* with scraper 203 is inclined in the rotational direction of scraper 203 (in the direction of the arrow in the drawing) as shown in FIG. 19 so that scraper 203 can ride over it properly. That is, abutment surface 301*d* is inclined so that it goes away in the rotational direction of scraper 203 from a normal L from rotational center ○ of toner bottle 200.

In other words, first dam portion 301*b* is disposed on the upstream side of the scraper 203's direction of toner conveyance, and first dam portion 301*b*'s abutment surface 301*d* with scraper 203 is arranged as a slope forming a predetermined angle β with normal L from the rotational center ○, to thereby define toner discharge chamber 300*d*. This angle β is determined as appropriate depending on the scraper 203's material, length and other factors.

As another feature, first dam portion 301*b* is disposed slightly away from toner discharge port 300*b* in the scraper's rotational direction. This arrangement enables easy accommodation of toner in toner discharge chamber 300*d*. In this way, by making toner easily be stored in toner discharge chamber 300*d*, it is possible to keep constant the amount of toner supply to be discharged through toner discharge port 300*b*. Thus, it is possible to realize stable toner supply.

Similarly to first dam portion 301*b*, second dam portion 302*b* is formed so that its abutment surface 302*d* with scraper 203 (the surface on the toner discharge control chamber 300*c* side) is arranged as a slope forming a predetermined angle β with normal L from the rotational center ○, to thereby define toner discharge chamber 300*d*. This angle β is determined as appropriate, depending on the scraper 203's material, length and other factors.

In connection to the above, the distance between first dam portion 301*b* and second dam portion 302*b* on the toner discharge chamber 300*d* side should at least have a distance that will not close toner discharge port 300*b*. Since it is necessary to accumulate a certain amount of toner in toner discharge chamber 300*d* from a viewpoint of stable toner supply, the distance should be specified as appropriate in accordance with the desired amount of toner being stored.

In addition, though the aforementioned scraper 203 was mentioned to have a plate-like configuration it should not be limited to this. For example, the scraper may have an essentially V-shaped cross-section. If scraper 203 has an essentially V-shaped cross-section, it can provide sealing function of sealing between the inner peripheral surface of bottle holder 300 and toner bottle 200, hence no separate sealing member is needed.

In accordance with the toner supply assembly 500 thus constructed, since toner bottle 200 is rotatably supported by bottle holder 300, there must be a certain amount of clearance between toner bottle 200 and bottle holder 300. Therefore, if no suitable seal is provided between toner bottle 200 and bottle holder 300, toner will leak out from other than toner discharge port 300*b* of bottle holder 300.

To deal with this, in the present embodiment, two V-rings 501 and 502 for providing a sealing function are attached on front end part 201*a* of main part 201 of toner bottle 200, as shown in FIG. 20.

V-ring 501 is fitted on a peripheral surface 201*i* of front end part 201*a* at a position outside the position where scrapers 203 are fixed, while V-ring 502 is fitted at the end surface, designated at 201*g*, of front end part 201*a* at a position inside the position where scrapers 203 are fixed.

Arranged further outside of the position where V-ring 501 is fitted is a slip ring 503 of a plate-like annular member for creating clearance between toner bottle 200 and bottle holder 300 and allowing toner bottle 200 to rotate smoothly.

V-ring 501 is attached to main part 201 with its sealing flange 501*a* pressed against slip ring 503, while V-ring 502 is attached to main part 201 with its sealing flange 502*a* pressed against the inner peripheral surface (described later) of bottle holder 300. In this way, these two V-rings 501 and 502 provide sealing function.

Slip ring 503 is fitted rotatably on peripheral surface 201*i* of front end part 201*a* of main part 201 and is adapted to be fixed to the inner peripheral surface of bottle holder 300 when toner bottle 200 is attached to bottle holder 300.

With this arrangement, slip ring 503 can be fixed to the bottle holder 300 side, so that main part 201 of toner bottle 200 will rotate along the inner peripheral surface of the slip ring 503.

Next, one example of slip ring 503 will be described with reference to the drawings.

Figure 21:
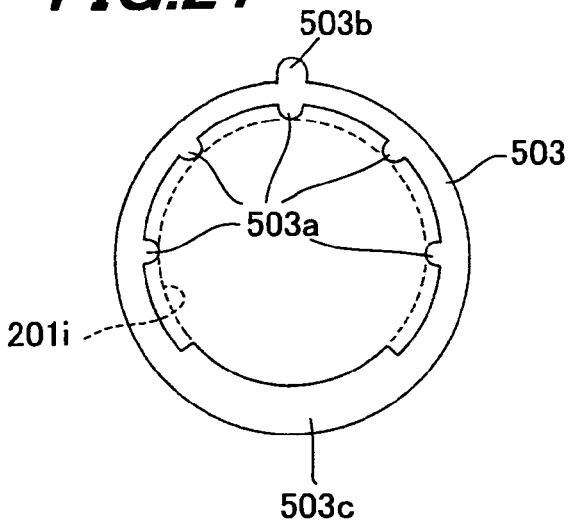
FIG. 21 is a plan view showing a configuration of a snap ring of the toner bottle.
Figure 22:
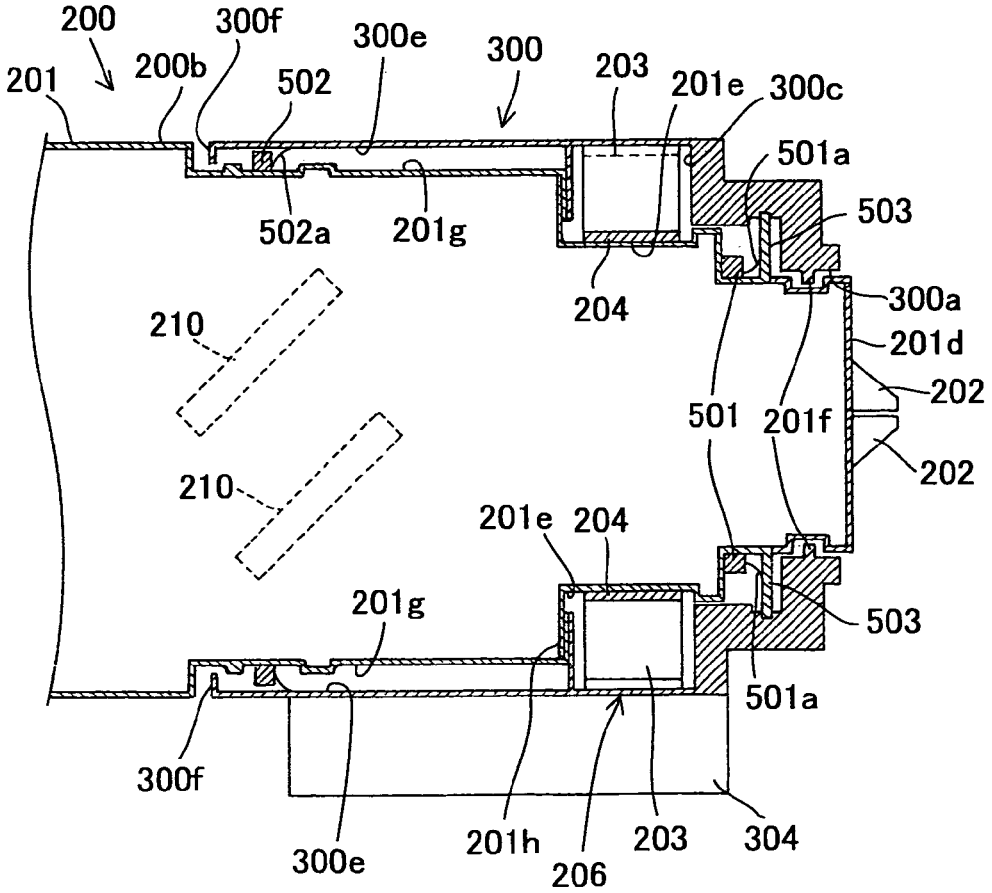
FIG. 22 is a schematic sectional view showing the bottle holder attached to the front end part of the toner bottle.

FIG. 21 is a plan view showing a configuration of a snap ring of a toner bottle as a part of the toner supply device according to the present embodiment, and FIG. 22 is a schematic sectional view showing a bottle holder attached to the front end part of the toner bottle.

As shown in FIG. 21, slip ring 503 is configured so that its inner periphery is formed with a plurality of projections 503*a* that will come into point contact with the fitted surface, i.e., peripheral surface 201*i*, in front end part 201*a* of main part 201 and an essentially arced supporting portion 503*c* that has the same curvature as the peripheral surface 201*i* and hence comes into line contact with peripheral surface 201*i* while a projection 503*b* is formed at the top of the outer peripheral surface. This projection 503*b* is fitted into an unillustrated cutout formed on the inner peripheral surface of bottle holder 300.

Since, in general, slip ring 503 and main part 201 of toner bottle 200 are adapted to slide along each other, it is possible to rotate toner bottle 200 smoothly without load if friction therebetween is minimized.

Accordingly, provision of multiple projections 503*a* that come into point contact with peripheral surface 201*i* (FIG. 20) on the inner peripheral surface of slip ring 503 as shown in FIG. 21 reduces the total contact area between toner bottle 200 and slip ring 503, hence making it possible to reduce friction between slip ring 503 and main part 201 of toner bottle 200. In this way, it is possible to reduce the rotational load which arises due to increase in friction, and hence rotate toner bottle 200 smoothly inside slip ring 503.

It is noted that the shape of slip ring 503 should not be limited to the configuration shown in FIG. 21, but slip ring 503 may have a shape that supports toner bottle 200 at pointed contacts, such as a polygonal shape, for example.

In sum, plate-like slip ring 503 has, on its inner periphery, an arc of line-contact projection 503*c*, which ranges in a predetermined angle and is margined with a predetermined clearance over peripheral surface 201*i* of toner bottle 201 and the remaining arc having a greater radius with multiple projections 503*a* projected inwards in parts therefrom.

With this configuration, the bottle can be supported by arced area at its bottom where the bottle weight acts thereon to prevent abrasion while the other part is supported by essentially pointed contacts, of multiple projections arranged at intervals of a predetermined distance or, of a polygonal shape, whereby it is possible to reduce the sliding load.

Further, since sealing flange 501*a* (FIG. 20) of V-ring 501 is adapted to abut this slip ring 503, it is possible to reliably prevent toner from leaking downward (in the direction of gravity) in bottle holder 300.

Also, V-ring 502 is attached to front end part 201*a* as shown in FIG. 22 so that its sealing flange 502*a* comes into pressing contact with inner peripheral surface 300*e* of bottle holder 300 when front end part 201*a* of main part 201 of toner bottle 200 is supported by bottle holder 300. This construction makes it possible to prevent toner leakage from the rear end 300*f* side of bottle holder 300.

It should be noted that the joint between first casing 301 and second casing 302 is properly sealed.

As described above, any portion of bottle holder 300 which is likely to cause toner leakage is completely sealed.

Further, formed on the peripheral surface of front end part 201*a* of main part 201 of toner bottle 200 are a plurality of plate-like ribs 210*s* made of elastic resin etc., and arranged obliquely in parallel to each other, as shown in FIG. 22, so that these ribs 210 will come into pressure contact with inner peripheral surface 300*e* of bottle holder 300 when toner bottle 200 is held by bottle holder 300. With this arrangement, it is possible to push out the toner that has entered the gap between toner bottle 200 and bottle holder 300 as these ribs 210 rotate.

As described, bottle holder 300 is composed of two separate casings, namely first and second casings 301 and 302, being joined together. When these first and second casings 301 and 302 are detachably joined, it is possible to easily replace the expendable sealing elements (V-rings 501, 502, slip ring 503, ribs 202) by unjoining first and second casings 301 and 302 when maintenance of toner supply device 100 is needed. This means improvement in maintenance of toner supply device 100.

In general, in order to avoid toner leakage and other defects, bottle holder 300 and toner bottle 200 need to be formed with dimensional accuracy, particularly in the supported portion of toner bottle 200 by bottle holder 300.

However, since toner bottle 200 is usually formed by blow molding, the toner bottles are prone to include variations in size when they are molded. Similarly, bottle holder 300 is also formed by blow molding, so that the bottle holders are prone to include variations in size when they are molded.

In the above embodiment, since V-ring 502 is made to provide sealing function by pressing its sealing flange 502*a* into contact with inner peripheral surface 300*e* of bottle holder 300 as described above, it is possible to absorb the size variations of bottle holder 300 and toner bottle 200 originating from molding, in the clearance between toner bottle 200 and bottle holder 300, or more clearly, in the space formed between the surface of main part 201 of toner bottle 200 and bottle holder 300.

Next, shutter mechanism 400 will be described with reference to the drawings.

Figure 23A:
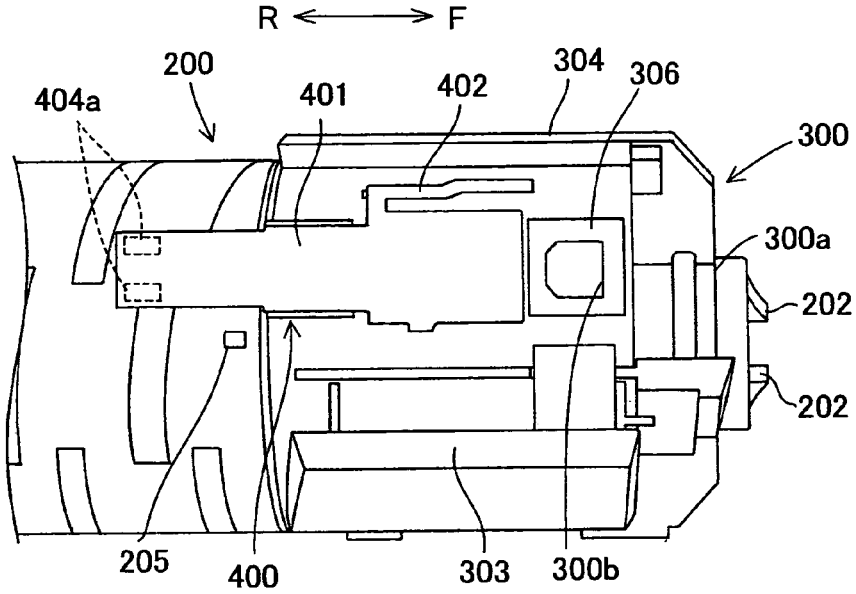
FIG. 23A is an illustrative view showing the bottle holder with its toner discharge port open.
Figure 23B:
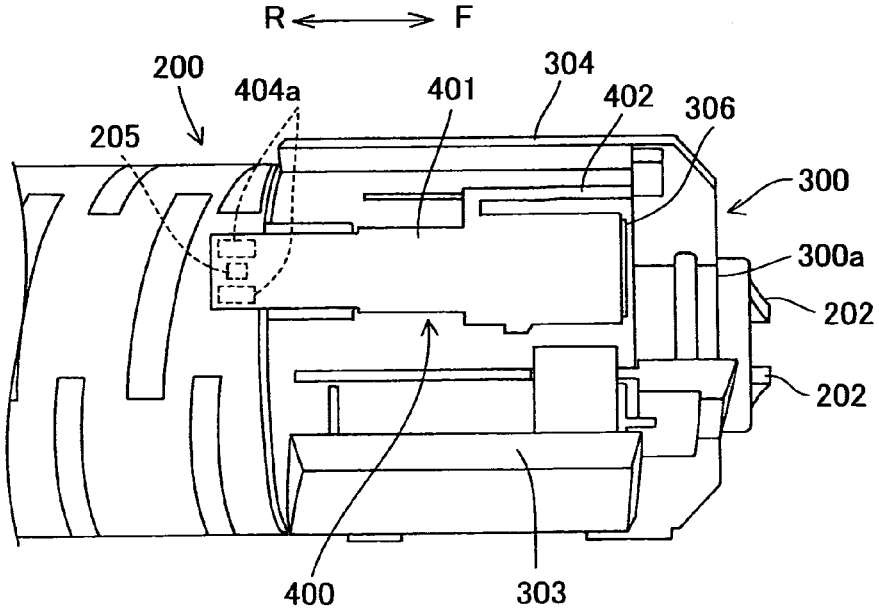
FIG. 23B is an illustrative view showing the bottle holder with the toner discharge port closed by a shutter mechanism.
Figure 24:
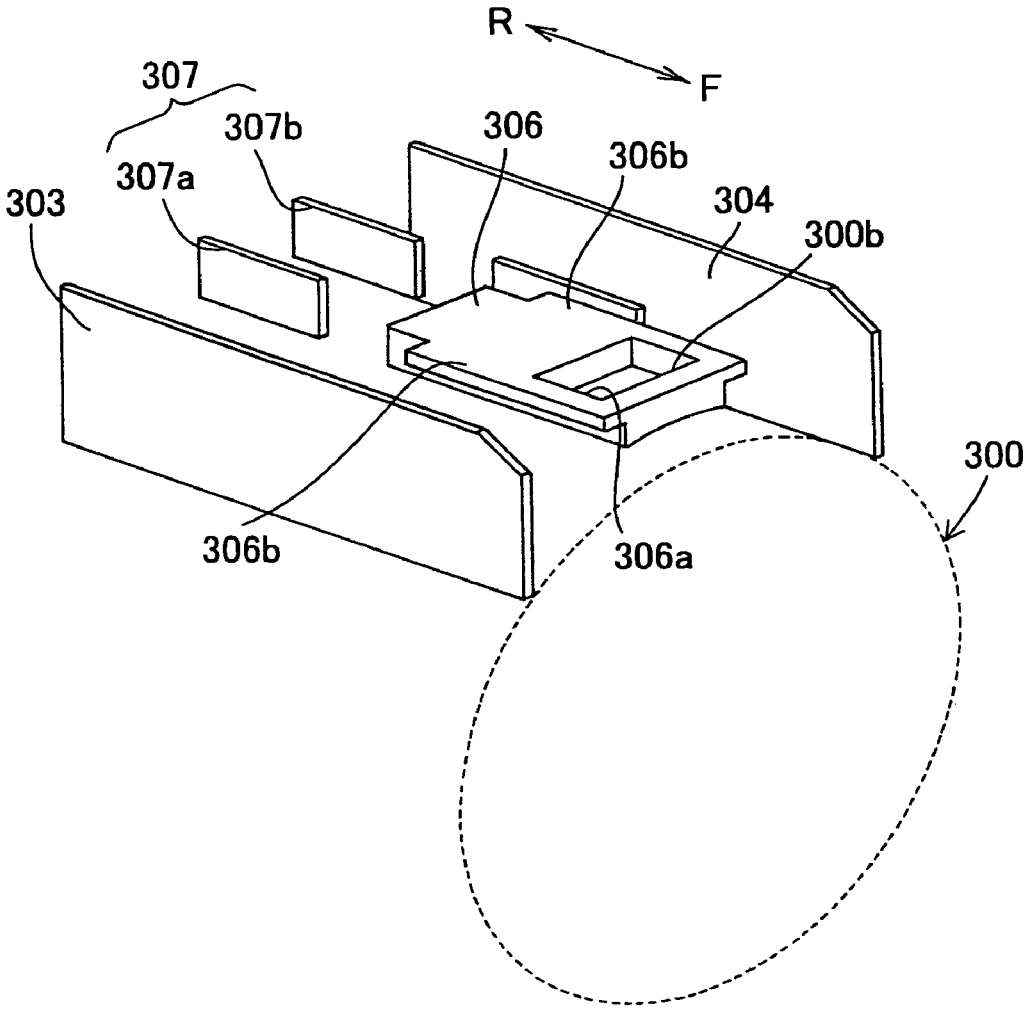
FIG. 24 is an illustrative view showing the schematic structure of the rear side of the bottle holder.

FIG. 23A is an illustrative view showing the bottle holder with its toner discharge port open, FIG. 23B is an illustrative view showing the bottle holder with the toner discharge port closed by a shutter mechanism, and FIG. 24 is an illustrative view showing the schematic structure of the rear side of the bottle holder.

As shown in FIGS. 23A and 23B, shutter mechanism 400 has a plate-like shutter member 401 that is slidable in the directions of arrows F and R, in the bottom of bottle holder 300. In the present embodiment, the side on which ribs 202, 202 of toner bottle 200 are projected from opening 300*a* at the front end of bottle holder 300 is called the front (F) side and the opposite is called the rear (R) side.

In shutter mechanism 400, as shutter member 401 slides in the direction of arrow R, toner discharge port 300*b* of bottle holder 300 is opened, as shown in FIG. 23A. When shutter member 401 slides in the direction of arrow F, toner discharge port 300*b* of bottle holder 300 is closed, as shown in FIG. 23B.

As shown in FIG. 24, bottle holder 300 is formed with first and second guide members 306 and 307 for guiding shutter member 401.

First guide member 306 is a flat plate-like member essentially parallel to the bottom surface of bottle holder 300 and is formed with an opening 306*a* that communicates with toner discharge port 300*b* of the bottle holder 300. Further, the side edge portions 306*b*, 306*b*, of first guide member 306, located at both sides with respect to the directions of arrows F and R, are formed to be thin with the attachment side to bottle holder 300 indented at both sides. These side edge portions 306*b*, 306*b* will function as guide rails for shutter member 401.

On the other hand, second guide member 307 consists of two guide plates 307*a* and 307*b* with their plate surfaces opposing each other, which are extended in the direction of arrow R on the downstream side, with respect to the direction of arrow R, of the attachment position of first guide member 306. These guide plates 307*a* and 307*b* will function as guide rails for shutter member 401.

Now, shutter member 401 will be described with reference to the drawings.

Figure 25A:
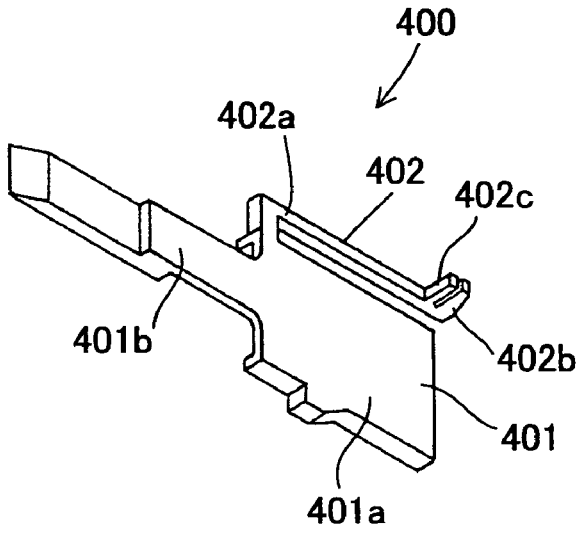
FIG. 25A is a perspective view showing the configuration of a shutter mechanism for a toner supply device in accordance with the present embodiment, when viewed from the front side.
Figure 25B:
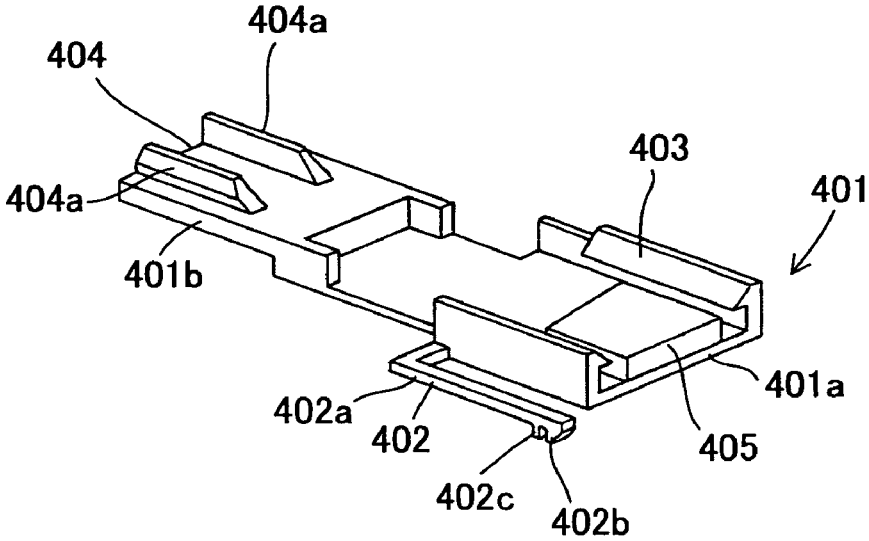
FIG. 25B is a perspective view showing the shutter mechanism when viewed from the rear side.
Figure 26A:
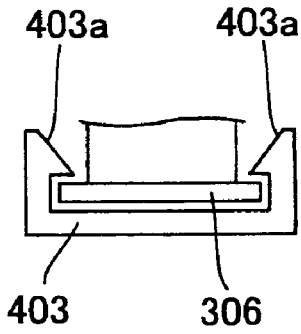
FIG. 26A is an illustrative view showing the relationship between the shutter mechanism and a first guide member of the bottle holder.
Figure 26B:
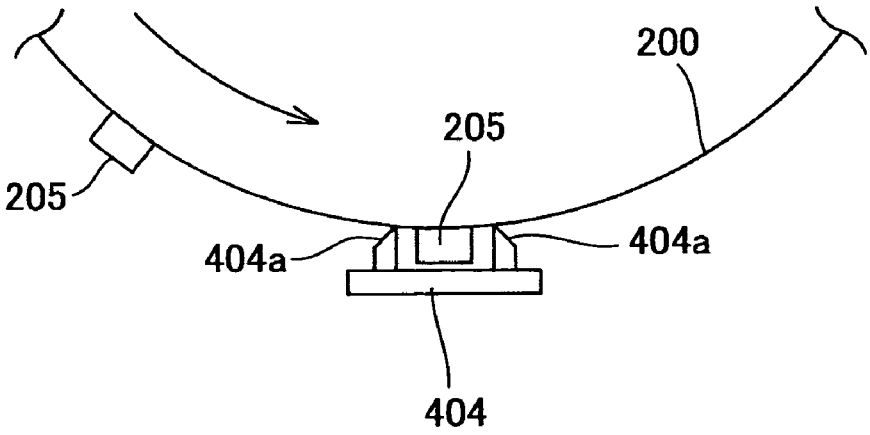
FIG. 26B is an illustrative view showing the relationship between the shutter mechanism and the rotation of the toner bottle.

FIG. 25A is a perspective view, viewed from the front side, showing the configuration of the shutter mechanism for the toner supply device in accordance with the present embodiment, FIG. 25B is a perspective view showing the shutter mechanism when viewed from the rear side, FIG. 26A is an illustrative view showing the relationship between the shutter mechanism and the first guide member of the bottle holder, and FIG. 26B is an illustrative view showing the relationship between the shutter mechanism and the rotation of the toner bottle.

Shutter member 401 is made of plate-like resin, and is composed of a shutter part 401*a* for actually covering the opening and a guide part 401*b* extended from the shutter part 401*a*.

As shown in FIG. 25A, shutter part 401*a* is formed with a regulating member 402 for limiting movement of shutter part 401*a*. This regulating member 402 is composed of an essentially L-shaped main piece 402*a* connected at its one end to shutter part 401*a* and first and second hooks 402*b* and 402*c* formed in the end opposite to the connected side with shutter part 401*a* of main piece 402*a*.

A predetermined gap is formed between first and second hooks 402*b* and 402*c*. The gap distance is determined such that the front end of second hook 402*c* touches first hook 402*b* when the former falls down towards the latter.

On the undersurface of shutter part 401*a*, a first slider 403 that slidably holds first guide member 306 (FIG. 24) having toner discharge port 300*b* of the aforementioned bottle holder 300 is formed extending in the longitudinal direction of shutter member 401, as shown in FIG. 25B. That is, as shown in FIG. 26A, first slider 403 slidably holds first guide member 306 by means of a pair of hooks 403*a*, 403*a* arranged at both sides.

On the underside of guide part 401*b*, a second slider 404 that is slidably supported by guide plates 307*a* and 307*b* of second guide member 307 is formed extending in the longitudinal direction of shutter member 401, as shown in FIG. 25B. Second slider 404 has a pair of slide plates 404*a*, 404*a* to be guided by guide plates 307*a*, 307*a* of second guide member 307.

Further, formed on the rear side (FIG. 25B) of shutter part 401*a* is a spongy Mylar seal 405 for hermetically sealing toner discharge port 300*b* of bottle holder 300. The size of Mylar seal 405 is not particularly limited as long as it can hermetically seal the toner discharge port 300*b* when shutter part 401*a* of shutter member 401 covers toner discharge port 300*b*.

Concerning slide plates 404*a*, 404*a* (FIG. 25B) of second slider 404, when shutter member 401 has moved to the arrow-F side (FIG. 24), or when opening 300*a* of bottle holder 300 is closed, projecting piece 205 (FIGS. 23A and 23B) formed on the toner bottle 200 surface fits between slide plates 404*a*, 404*a* as shown in FIG. 26B to thereby restrain the toner bottle 200 from rotating. When shutter member 401 is moved in the direction of arrow R, slide plates 404*a*, 404*a* also move in the direction of arrow R to thereby cancel the engagement with projecting piece 205 (FIG. 23A).

This movement cancels restraint on toner bottle 200's rotation. That is, when toner discharge port 300*b* of bottle holder 300 is released so that toner supply device 100 makes a toner supply operation, rotation of toner bottle 200 will not be hindered.

Next, toner supply assembly mounting mechanism 600 will be described with reference to the drawings.

Figure 27:
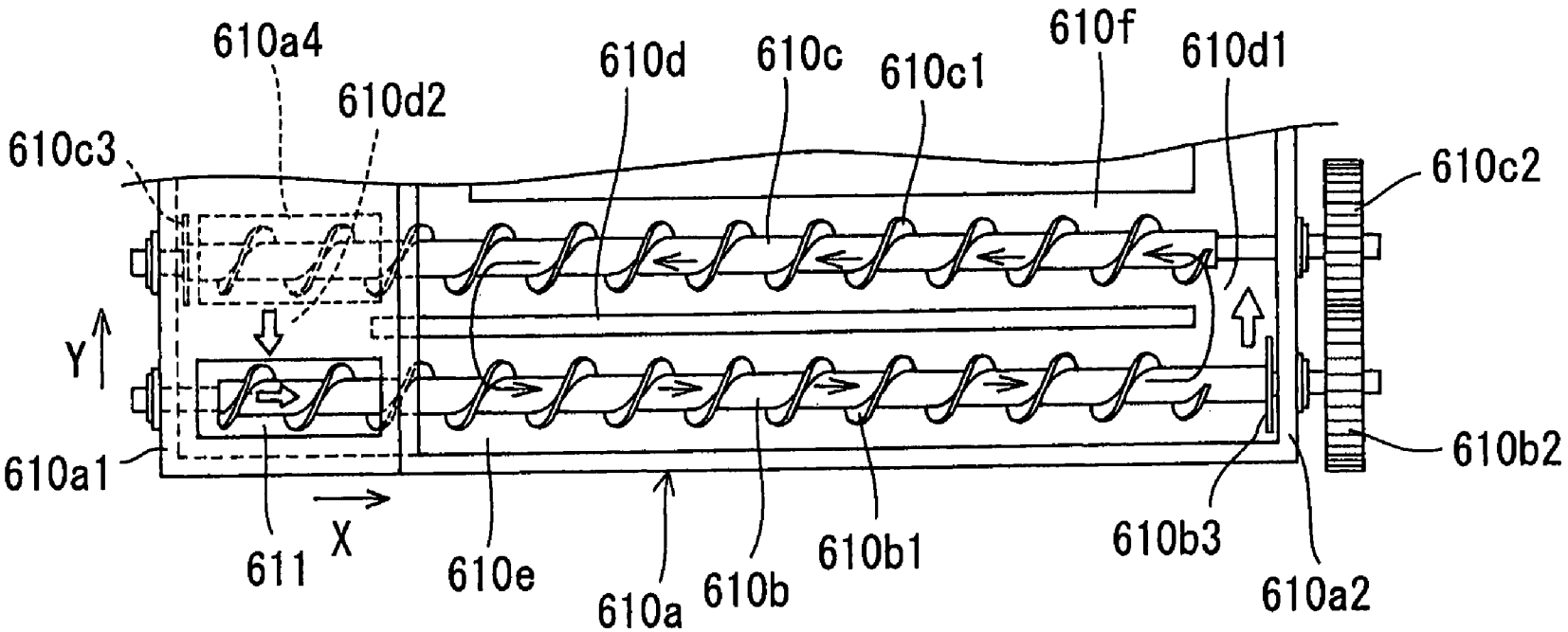
FIG. 27 is an illustrative view showing the structure of the toner supply assembly mounting mechanism.
Figure 28:
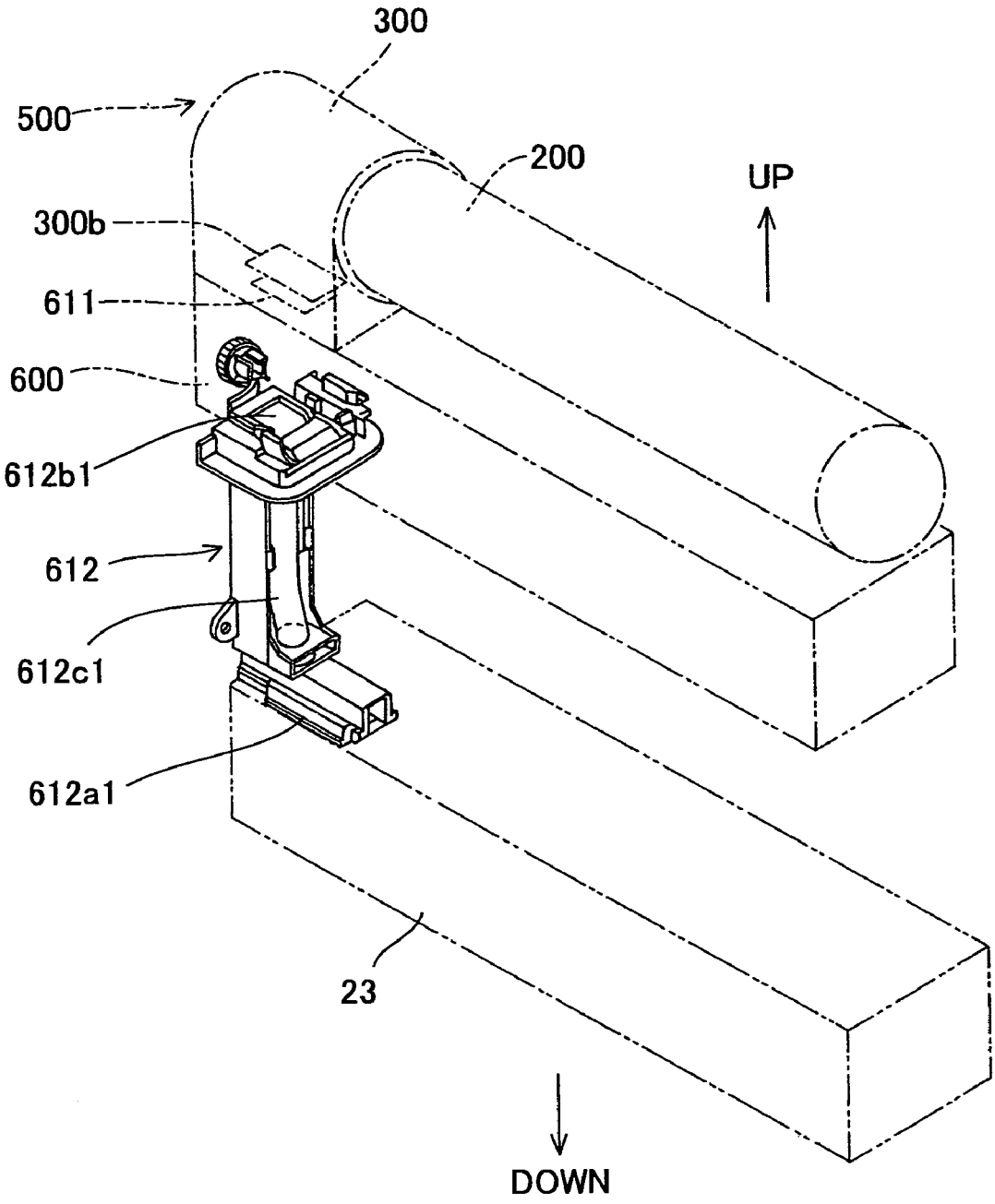
FIG. 28 is an illustrative view showing the structure of a supply passage part for coupling the toner supply assembly mounting mechanism with a developing unit.

FIG. 27 is an illustrative view showing the structure of a toner supply assembly mounting mechanism as a part of a toner supply device according to the present embodiment, and FIG. 28 is an illustrative view showing the structure of a supply passage part for coupling the toner supply assembly mounting mechanism with a developing unit.

As shown in FIGS. 1, 2, 5 and 6, toner supply assembly mounting mechanism 600 is constructed such that toner supply assembly 500 is disposed essentially parallel to, and opposing, developing unit 23 with transfer belt unit 30 disposed therebetween. Toner supply assembly mounting mechanism 600 is constructed so that two toner supply assemblies 500*a* for storing black toner can be mounted together.

In toner supply assembly mounting mechanisms 600, mount bases 602 (602*a* to 602*d*, FIGS. 5 and 6) onto which toner supply assemblies 500 are mounted are formed lengthwise in the direction (the transfer belt width direction) approximately perpendicular to the transfer belt's direction of conveyance.

As shown in FIG. 5, toner supply assemblies 500 are fixed to corresponding drive mechanisms 701 (701*a* to 701*d*), respectively, on the bottle holder 300 side while toner bottles 200 are fixed by holding belts 702 on the opposite side.

Provided for each drive mechanism 701 is an actuator (not shown) which, when toner supply assembly 500 is mounted to mount base 602, transfers driving force (rotational force) to the bottle by coupling itself with toner bottle 200's ribs 202 (FIG. 7) that are projected from opening 300*a* of the aforementioned bottle holder 300. Usually, the actuator is composed of a motor, and is controlled to drive in accordance with the toner supply condition.

On the other hand, holding belt 702 (FIG. 5) is adapted to hold toner bottle 200 of the toner supply assembly 500 when toner supply assembly 500 is mounted to mount base 602, and is removably attached to mount base 602. Holding belt 702 is attached to mount base 602 to hold toner bottle 200, leaving a clearance so that the toner bottle 200 is rotatable or touching the toner bottle 200 with such friction as to allow the bottle to rotate.

In toner supply assembly mounting mechanism 600, each mount base 602 on which toner supply assembly 500 is to be mounted, has a toner feed port 611 (611*a*, 611*b*, 611*c* or 611*d*) on the upper surface thereof as shown in FIG. 6. This toner feed port is disposed at one end side on the upper surface where bottle holder 300 of toner supply assembly 500 is mounted, corresponding to shutter mechanism 400 for the bottle holder 300. On the underside of the mount base, supply passage part 612 (612*a*, 612*b*, 612*c* or 612*d*) for toner conveyance is provided to establish communication between the toner supply port 611 and developing unit 23 that is arranged under toner supply assembly mounting mechanism 600.

Here in FIG. 6, for description convenience, mount base 602*a* corresponding to toner supply assembly 500*a* of black toner is partially omitted.

Supply passage part 612*a* provided in mount base 602*a* for toner supply assembly 500*a* for black toner has two toner feed ports 611*a*, 611*a* corresponding to two toner supply assemblies 500*a*. That is, this supply passage part is constructed so as to receive toner fed from the two ports and feed the toner to single developing unit 23*a* for black toner through toner input port 234*a* (FIGS. 2 and 3) formed in developing unit 23*a*.

Each toner supply assembly mounting mechanism 600 is constructed as shown in FIGS. 3 and 27 such that toner fed from toner supply assembly 500 is delivered from toner feed port 611 that is disposed outside the area of the transfer belt with respect to the direction perpendicular to the transfer belt's direction of conveyance, or in short, outside the width W of the transfer belt.

On the other hand, each of mount bases 602*b* to 602*d* of toner supply assemblies 500*b* to 500*d* for cyan, magenta and yellow toners is formed with a box-shaped casing 610*a* (FIG. 27) that is elongated in the width direction of the transfer belt. The casing 610*a* incorporates a first toner agitator shaft (toner conveyor means) 610*b* and a second toner agitator shaft (toner conveyor means) 610*c*, arranged parallel to each other along the axis direction of developing roller 231.

The interior of casing 610*a* is divided into a first toner chamber (toner reservoir) 610*e* with first toner agitator shaft 610*b* disposed therein and a second toner chamber (toner reservoir) 610*f* with second toner agitator shaft 610*c* disposed therein, by a partitioning element 610*d*.

First and second toner agitator shafts 610*b* and 610*c* have screws 610*b*1 and 610*c*1 for agitating and conveying toner, respectively, and are driven by an unillustrated drive motor by way of drive gears 610*b*2 and 610*c*2 arranged on the other side 610*a*2 of casing 610*a*.

Toner support plates 610*b*3 and 610*c*3 are provided for first and second toner agitator shafts 610*b* and 610*c*, respectively, at their downstream side ends with respect to the toner conveying direction so as to receive the toner being conveyed.

Here, the toner agitating means should not be limited to screws 610*b*1 and 610*c*1, but it may be a structure in which a multiple number of agitating vanes tilted with the toner conveying direction are formed on the first and second toner agitator shafts 610*b* and 610*c*, for example. Also any other configuration can be used as long as it can achieve the same effect.

Partitioning element 610*d* is formed in casing 610*a* along the casing length or along the first and second agitator shafts 610*b* and 610*c*, having toner chamber communication ports 610*d*1 and 610*d*2 formed near both side walls of casing 610*a* to allow for toner passage between first and second toner chambers 610*e* and 610*f*. These toner chamber communication ports 610*d*1 and 610*d*2 permit toner to circulate from first toner chamber 610*e* to second toner chamber 610*f* and from second toner chamber 610*f* to first toner chamber 610*e*.

On the first end side, designated at 610*a*1, of casing 610*a*, a toner feed port 611 for receiving toner supply from toner bottle 200 arranged on the top thereof is formed while a toner feed port 610*a*4 for delivering the toner from casing 610*a* to supply passage part 612 (FIGS. 2 and 3) that feeds toner to developing unit 23 arranged below is formed.

The opening of toner feed port 611 is formed at a position opposing part of first toner agitator shaft 610*b* for agitating and conveying toner from first end side 610*a*1 to second end side 610*a*2 of casing 610*a*.

On the other hand, the opening of toner feed port 610*a*4 is formed at a position opposing part of second toner agitator shaft 610*c* for agitating and circulatively conveying toner from second end side 610*a*2 to first end side 610*a*1 of casing 610*a*.

Each supply passage part 612 is formed so that its top is integrated with toner supply assembly mounting mechanism 600, and a developing unit attachment portion 612*a*1 for detachable attachment to developing unit 23 is provided at the bottom thereof, as shown in FIG. 28.

An opening of a toner input port 612*b*1 for toner input is formed at the top of supply passage part 612, and a toner passage 612*c*1 for toner to pass from this toner input port 612*b*1 to developing unit attachment portion 612*a*1 is provided approximately linearly from top to bottom.

Further, as shown in FIG. 6, at one end side on the top of casing 610*a* of each mount base 602, bottle holder guide portions 620, 620 that engage guide portions 303*c* and 304*c* (FIG. 7B) of first and second fixing structures 303 and 304 are projectively formed at the positions opposing first and second fixing structures 303 and 304 (FIG. 7B) of bottle holder 300 when toner supply assembly 500 has been mounted. Bottle holder guide portions 620, 620 are arranged essentially parallel to each other with toner feed port 611 positioned therebetween and extended in the longitudinal direction of mount base 602.

Toner feed port 611 of mount base 602 is formed at the position corresponding to shutter member 401 (FIG. 23A) of shutter mechanism 400 provided for bottle holder 300 when toner supply assembly 500 is mounted. In other words, each mount base is formed with toner feed port 611 that is positioned so as to be able to receive toner discharged from toner discharge port 300*b* when the toner discharge port 300*b* of bottle holder 300 is released by shutter mechanism 400.

Formed in the vicinity of each toner feed port 611 is a projection piece 613 (613*a* to 613*d*, FIG. 6) for limiting the movement of shutter member 401. This projection piece is hooked by a hooking portion (described later) of regulating member 402 (FIGS. 23A and 25A) provided for shutter member 401 of shutter mechanism 400.

On the side longitudinally opposite to toner feed port 611 of mount base 602, a supporter 614 (614*a* to 164*d*) for supporting the rear end (the end on the side opposite to the mounted portion of bottle holder 300) of toner bottle 200 when toner supply device 100 is mounted is formed.

This supporter 614 is to create a predetermined clearance between toner bottle 200 and mount base 602 and functions to smoothen the rotation of toner bottle 200. Here, the configuration and the like of supporter 614 is not particularly limited; any configuration and material can be used as long as it permits toner bottle 200 to rotate smoothly.

The forming position of projection piece 613 provided near toner feed port 611 is determined by the regulatory operation of regulating member 402.

Next, how the forming position of projection piece 613 is determined will be described with reference to the drawings.

Figure 29A:
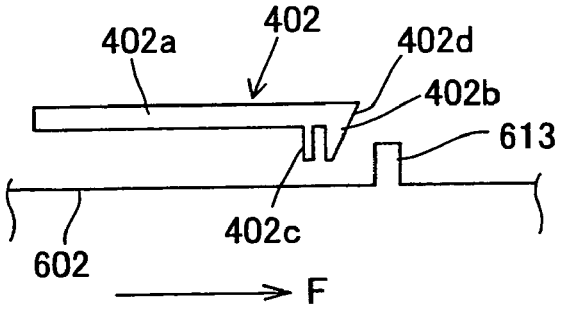
FIG. 29A is an illustrative view showing the positional relationship between a regulating member and a projection piece before the toner supply device is mounted to a mount base.
Figure 29B:
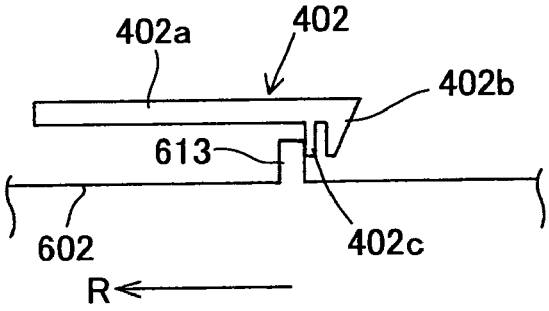
FIG. 29B is an illustrative view showing the positional relationship between a regulating member and a projection piece when the toner supply device has been mounted to a mount base.
Figure 29C:
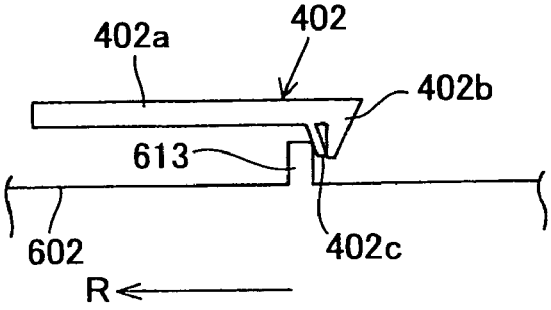
FIG. 29C is an illustrative view showing the positional relationship between a regulating member and a projection piece when the toner supply device is dismounted from a mount base; and, FIG. 30 is an illustrative view showing an overall configuration of a copier according to another embodiment.

FIG. 29A is an illustrative view showing the positional relationship between the regulating member and the projection piece before the toner supply device according to the present embodiment is mounted to the mount base; FIG. 29B is an illustrative view showing the positional relationship between the regulating member and the projection piece when the toner supply device has been mounted to the mount base; and FIG. 29C is an illustrative view showing the positional relationship between the regulating member and the projection piece when the toner supply device is dismounted from the mount base.

Projection piece 613 is formed at such a position that shutter member 401 will open toner discharge port 300*b* of bottle holder 300 by its engagement with regulating member 402 when toner supply device 100 has been completely attached to mount base 602 and will close toner discharge port 300*b* of bottle holder 300 when toner supply device 100 is removed from mount base 602.

Regulating member 402 has first hook 402*b* and second hook 402*c* formed at the front end (on the side of engagement with projection piece 613) of main piece 402*a*, as already mentioned.

First hook 402*b* is disposed at a position more front than second hook 402*c* and its abutment surface 402*d* against projection piece 613 is formed beveled so that it can easily ride over the projection piece 613. Here, abutment surface 402*d* is so inclined that its contact area with the top of projection piece 613 is minimized.

When abutment surface 402*d* of first hook 402*b* is inclined in this way, regulating member 402 is moved in the direction of arrow F from the state shown in FIG. 29A, and first hook 402*b* rides over projection 613 formed on first casing 301. With a further movement of the regulating member in the direction of arrow F, second hook 402*c* also rides over projection 613. From this state, when regulating member 402 is caused to move in the direction opposite to the direction of arrow F, movement of regulating member 402 is obstructed by projection piece 613 and second hook 402*c* (the state shown in FIG. 29B).

Next, how toner supply device 100 is mounted to the image forming apparatus will be described.

Toner supply device 100 is adapted to be mounted to toner supply assembly mounting mechanism 600 by sliding bottle holder 300 side of toner supply assembly 500 over and along mount base 602 of toner supply assembly mounting mechanism 600.

By this sliding movement of toner supply assembly 500, shutter member 401 of shutter mechanism 400, provided for bottle holder 300, opens or closes toner discharge port 300*b* of the bottle holder 300, as shown in FIGS. 29A, 29B and 29C.

Movement of shutter member 401 is controlled by regulating member 402 that is integrally formed with shutter member 401.

In the case where toner discharge port 300*b* of bottle holder 300 is opened by shutter mechanism 400, as shutter member 401 moves in the direction of arrow R, regulating member 402 moves and takes the state shown in FIG. 29B. Then, with a further movement in the direction of arrow R, second hook 402*c* abuts projection piece 613 and falls down to the first hook 402*b* side, as shown in FIG. 29C, so that the first hook 402*b* together with second hook 402*c* ride over projection piece 613 as the movement in the direction of arrow R continues. In this way, toner discharge port 300*b* of bottle holder 300 is released.

In the case where toner supply assembly 500 is dismounted from toner supply assembly mounting mechanism 600, as toner supply assembly 500 is pulled out from toner supply assembly mounting mechanism 600, the aforementioned actions take place in the reverse order, that is, shutter member 401 moves in the direction of arrow F (FIG. 29A) so that toner discharge port 300*b* of bottle holder 300 is closed.

Next, the operation of supplying toner to developing unit 23 by toner supply device 100 using toner bottle 200 will be described.

Toner bottle 200 has been mounted to toner supply assembly mounting mechanism 600 with bottle-side toner discharge port 201*h* sealed with sealing element 220.

When toner is supplied to developing unit 23, driving mechanism 701 provided for toner supply assembly mounting mechanism 600 causes toner bottle 200 to rotate. As a result, sealing element 220 is peeled off toner bottle 200 to open bottle-side toner discharge port 201*h* of toner bottle 200, so that toner will be able to be supplied from bottle-side toner discharge port 201*h*.

Detailedly, in toner supply assembly mounting mechanism 600, bottle holder 300 is supported so as not to be rotatable while only toner bottle 200 is supported so as to be rotatable. As this toner bottle 200 rotates, sealing element 220 adhered to the toner bottle 200 also rotates.

Since sealing element 220 is bonded at its first end 220*a* to toner bottle 200 while second end 220*b* is bonded to wall portion 301*c* of bottle holder 300, the sealing element is tensioned as toner bottle 200 turns a predetermined amount.

Sealing element 220's first end 220*a* that is adhered to the toner bottle 200 side is pulled in the direction that forms an obtuse angle (approximately 180 degrees opposite to) with end face 201*g* of toner bottle 200, the first end can be easily peeled off.

On the other hand, sealing element 220's second end 220*b* that is bonded to wall portion 301*c* of bottle holder 300 is pulled in the direction that forms an acute angle (approximately parallel to) with wall portion 301*c* of bottle holder 300, so that the second end is hard to be pulled off.

Further, since the adhesive strength with which sealing element 220's second end 220*b* is bonded is specified to be greater than the adhesive strength with which first end 220*a* is bonded, as sealing element 220 is pulled with rotation of toner bottle 200, sealing element 220's first end 220 bonded to toner bottle 200 is peeled off so that bottle-side toner discharge port 201*h* of toner bottle 200 is opened.

In this way, as toner bottle 200 rotates, sealing element 220 is automatically peeled off toner bottle 200 so that bottle-side toner discharge port 201*h* of toner bottle 200 is released, whereby toner supply is enabled.

Sealing element 220 that has been peeled from toner bottle 200 stays inside bottle holder 300 with its second end 220*b* remaining to be fixed to wall portion 301*c* of bottle holder 300.

As toner bottle 200 further rotates, toner discharged from toner bottle 200 is conveyed from the interior of bottle holder 300 to toner supply assembly mounting mechanism 600 by means of scrapers 203 that are integrally formed with toner bottle 200, and the toner is agitated by the toner supply assembly mounting mechanism 600 and then fed to developing unit 23.

When toner supply is halted, the rotation of toner bottle 200 is stopped so as to stop toner conveyance from toner bottle 200. At this point, the movement of toner bottle 200 is controlled by an unillustrated rotational position detecting sensor for sensing toner bottle 200 so that one of lid portions 203*b* of multiple scrapers 203 will be positioned to oppose toner discharge port 300*b* of bottle holder 300.

With this arrangement, toner discharge port 300*b* of bottle holder 300 can be closed by lid portion 203*b* of scraper 203 when toner bottle 200 stops rotating, so that it is possible to totally stop the toner supply. As a result, if image forming apparatus 1 is moved or even shaken, there is no risk of toner being unintentionally delivered from toner supply device 100 to developing unit 23.

In accordance with the present embodiment thus configured, since sealing element 220 for sealing bottle-side toner discharge port 201*h* of toner bottle 200 is bonded to both toner bottle 200 and bottle holder 300, it is possible to automatically peel off sealing element 220 to open bottle-side toner discharge port 201*h* of toner bottle 200 and supply toner, by just rotating the fitted toner bottle 200.

Thus, this configuration makes it possible to simply handle the toner bottle 200 without causing any spill of toner therefrom when it is carried and facilitates replacement of toner bottle 200 without making the operator and the machine dirty with spilt toner at all when toner needs to be supplied. As a result it is possible to markedly improve the operativity and maintenance performance.

Further, according to the present embodiment, since sealing element 220 is formed of a flexible member, it is possible to make the peeling action easy and there is no fear of the sealing element being stuck or torn off inside bottle holder 300 and blocking the toner discharge port even though the peeled seal remains inside bottle holder 300.

Moreover, according to the present embodiment, since sealing element 220 is formed of a material that is air-permeable and presents good slidability, in addition to the above effect it is possible to store toner in a stable condition without causing any deformation of toner bottle 200 and any toner leakage even when there occurs a pressure difference between the interior and exterior of toner bottle 200 due to change in air pressure while toner bottle 200 is transported or kept in storage.

Here, the material used for sealing element 220 should not be particularly limited as long as it provides the above functions.

Furthermore, according to the present embodiment, since sealing element 220 is formed in an arc shape that covers a range of 180 degrees along the toner bottle's peripheral direction, the sealing element 220, even if it is separated from toner bottle 200, will not block the toner discharge port when the port is located at the predetermined position, hence it is possible to discharge toner properly.

Still, the shape and length of sealing element 220 of the present technology should not be limited to this, but can be specified appropriately depending on the shape of the toner container and the size of the toner discharge port.

Though in the present embodiment, bottle-side toner discharge port 201*h* is formed on end face 201*g* of toner bottle 200's main part 201 and this bottle-side toner discharge port 201*h* is sealed with sealing element 220, this should not limit the toner discharge structure; for example, with a toner discharge port formed in the outer peripheral side of toner bottle 200, an equivalent structure that presents the same effect as the sealing element 220 of the present embodiment can be provided.

Though the present embodiment has been described taking an example in which toner supply device 100 using toner bottle 200 is applied to the image forming apparatus 1 shown in FIG. 1, it should not be limited to the above and can be applied to any kinds of image forming apparatuses as long as they can use equivalent toner supply device and developing unit. For example, a copier 101 as shown in FIG. 30 may be used.

Figure 30:
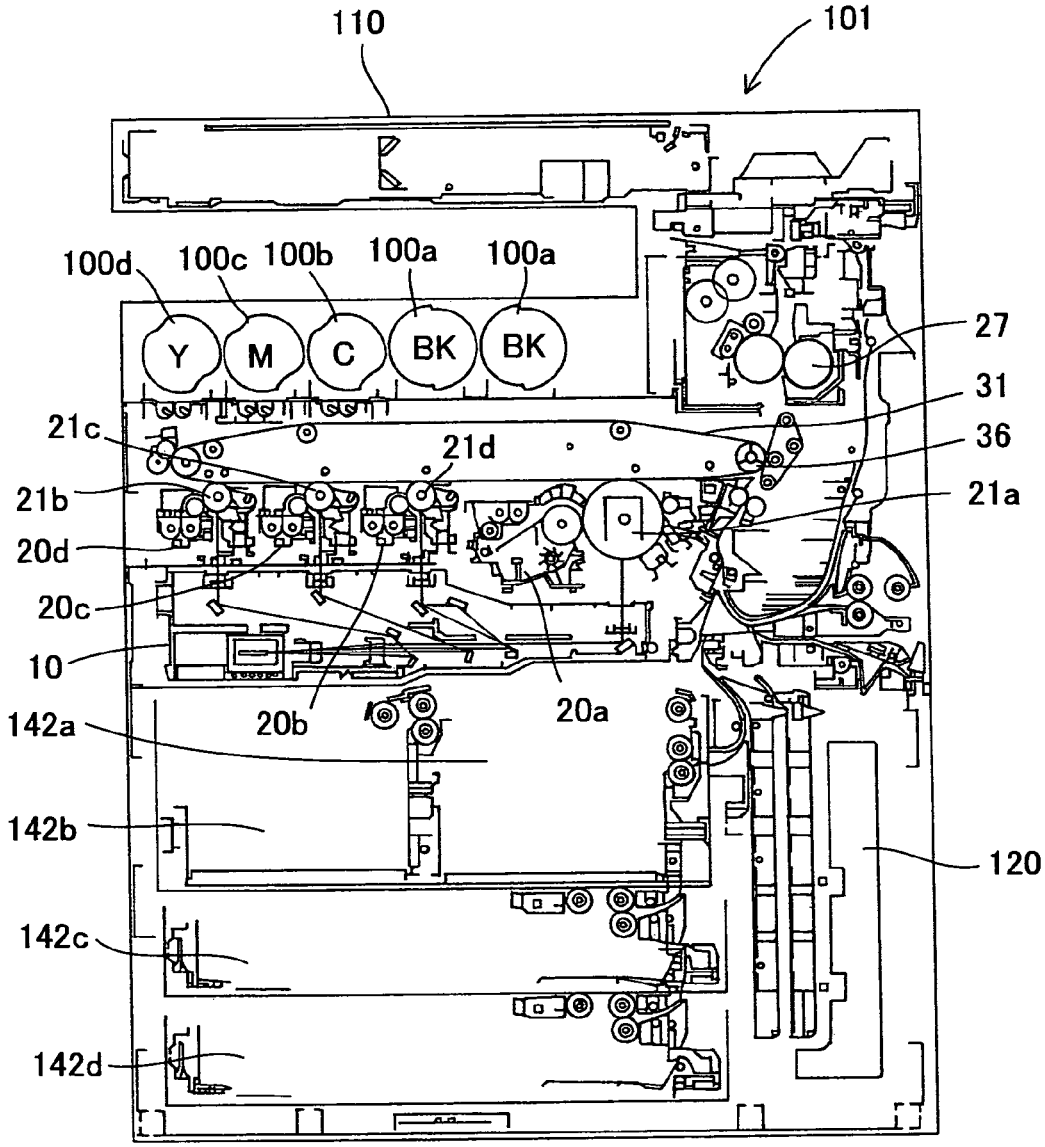

As shown in FIG. 30, copier 101 includes an image reader (scanner) 110 disposed above an image forming portion 108 using toner bottle 200 and having almost the same configuration as that of image forming apparatus 1 according to the present embodiment, and first, second, third and fourth paper feed cassettes 142*a*, 142*b*, 142*c* and 142*d* disposed under image forming portion 108 for supporting multiple kinds of paper, to thereby facilitate a variety of and a large amount of automatic printing.

In the drawing, a reference numeral 120 designates a waste toner box for collecting waste toner.

Here, in copier 101, the same components as those in image forming apparatus 1 of the aforementioned embodiment will be allotted with the same reference numerals and description is omitted.

Further, the present technology can be developed into any form of other kinds of image forming apparatuses etc., not limited to the image forming apparatus and copier having the above configurations, as long as it is an image forming apparatus needing a supply of developer (toner).

As has been described above, the present technology should not be limited to the above embodiment and example and various changes can be made within the range specified in the scope of claims. That is, any embodied mode obtained by combination of technical means modified as appropriate without departing from the spirit and scope should be included in the technical art.

What is claimed is:

1. A toner container, comprising:

a cylindrical toner container body having a toner storing portion filled with toner and a toner discharge port for discharging toner held in the toner storing portion, wherein the toner discharge port is formed on a first end face of the container body that extends in a plane that is substantially perpendicular to a longitudinal axis of the container body, wherein the toner held in the toner storing portion is discharged out of the container by rotating the toner container body around the longitudinal axis of the toner container body; and a sealing element for sealing the toner discharge port, wherein the sealing element is formed of an arcuate-shaped flexible member having a first end that is attached to the first end face of the container body and that is peeled off the toner container body to open the toner discharge port as the toner container body rotates.

2. The toner container according to claim 1, further including a toner container holder that covers the first end face of the toner container body including the toner discharge port and that supports the toner container body in a rotatable manner, wherein a second end of the sealing element is attached to the toner container holder.

3. The toner container according to claim 2, wherein when the first end of the sealing element is still attached to the toner container body and sealing the toner discharge port, the second end of the sealing element is folded over the first end and fixed to the toner container holder, and the folded portion of the sealing element is located on the downstream side of the first end of the sealing element with respect to the toner container body's direction of rotation.

4. The toner container according to claim 2, wherein when the first end of the sealing element is still attached to the toner container body, the first end of the sealing element makes an acute angle with the second end of the sealing element which is attached to the toner container holder.

5. The toner container according to claim 2, wherein the sealing element is adhered to the toner container body by thermal fusing.

6. The toner container according to claim 2, wherein the adhesive strength with which the sealing element is fixed to the toner container holder is specified to be greater than the adhesive strength with which the sealing element seals the toner discharge port of the toner container body.

7. The toner container according to claim 2, wherein after the first end of the sealing element is separated from the toner container body, the sealing element remains inside the toner container holder with the second end thereof fixed to the toner container holder.

8. The toner container according to claim 2, wherein the second end of the sealing element is attached to a stationary surface of the toner container holder that is oriented substantially parallel to the first end face of the toner container body.

9. The toner container according to claim 1, wherein the sealing element is formed of a material having air-permeability.

10. The toner container according to claim 1, wherein the sealing element is formed of a material having good slidability.

11. The toner container according to claim 1, wherein the sealing element is formed in an arcuate shape covering an angular range of approximately 180 degrees with respect to the peripheral direction of the toner container body.

12. A toner supply device comprising:

a toner container as recited in claim 1; and, a toner feed device having the toner container mounted thereon for feeding the toner discharged from the toner container to a developing unit.

13. A toner container, comprising:

a cylindrical toner container having a toner discharge port formed in a first wall of the container that extends in a plane that is substantially perpendicular to a longitudinal axis of the container;

a toner container holder that covers the first wall of the toner container and the discharge port; and an arcuate-shaped sealing element having a first end that is initially attached to the first wall of the toner container to seal the discharge port, and having a second end that is attached to the toner container holder, wherein rotation of the toner container with respect to the toner container holder causes the first end of the sealing element to peel off of the first wall of the toner container to open the toner discharge port.

14. The toner container according to claim 13, wherein when the first end of the sealing element is still attached to the first wall of the toner container, the arcuate-shaped sealing element is folded such that the first and second ends of the sealing element form an acute angle.

15. The toner container according to claim 14, wherein the second end of the sealing element is attached to a wall of the toner container holder that is oriented substantially parallel to the first wall of the toner container.

16. The toner container according to claim 14, wherein after rotation of the toner container with respect to the toner container holder has removed the first end of the sealing element from the first end of the toner container, the sealing element remains attached to the toner container holder.

17. The toner container according to claim 13, wherein a bond between the first end of the sealing element and the first wall of the toner container is weaker than a bond between the second end of the sealing element and the toner container holder.

18. The toner container according to claim 13, wherein the first end of the sealing element is attached to the first wall of the toner container by heat sealing.

19. A toner supply device comprising the toner container of claim 13.

* * * * *